US012733740B2

(12) United States Patent
Lee

(10) Patent No.: US 12,733,740 B2
(45) Date of Patent: Sep. 15, 2026

(54) ADJUSTMENT DEVICE

(71) Applicant: Secretlab SG Pte. Ltd., Singapore (SG)

(72) Inventor: Xue Ying Lee, Singapore (SG)

(73) Assignee: SECRETLAB SG PTE. LTD., Singapore (SG)

( * ) Notice: Subject to any disclaimer, the term of this patent is extended or adjusted under 35 U.S.C. 154(b) by 141 days.

(21) Appl. No.: 18/648,535

(22) Filed: Apr. 29, 2024

(65) Prior Publication Data

US 2025/0331645 A1 Oct. 30, 2025

(51) Int. Cl.
*A47C 7/50* (2006.01)

(52) U.S. Cl.
CPC ..... *A47C 7/5068* (2018.08)

(58) Field of Classification Search
CPC ..... A47C 16/025; A47C 7/506
See application file for complete search history.

(56) References Cited

U.S. PATENT DOCUMENTS

| | | | |
|---|---|---|---|
| 1,217,246 A | 2/1917 | Wallace | |
| 3,606,458 A | 9/1971 | Attinger | |

FOREIGN PATENT DOCUMENTS

| | | | | |
|---|---|---|---|---|
| CN | 108402763 A | * | 8/2018 | ..... A47C 6/025 |
| CN | 111265042 A | * | 6/2020 | ..... A47C 7/002 |
| WO | 9935939 A1 | | 7/1999 | |

OTHER PUBLICATIONS

PE2E English Translation of CN-111265042-A (Year: 2020).*
International Search Report issued for the corresponding International patent application No. PCT/SG2025/050281, dated Jun. 24, 2025, 3 pages (for informational purposes only).

* cited by examiner

*Primary Examiner* — Nicholas McFall
*Assistant Examiner* — Eric Acosta
(74) *Attorney, Agent, or Firm* — VIERING, JENTSCHURA & PARTNER mbB

(57) ABSTRACT

A dual-axis adjustment device is provided. The adjustment device comprises a pivoting component configured to allow a top component of a furniture piece to rotate about a first axis with respect to a stand, and a lock component configured to allow the top component to slide relative to the stand along a second axis (BB'). The pivoting component and the lock component are arranged along a common axis (AA'), the first axis is a rotational axis, and the common axis (AA') is co-axial with the first axis and perpendicular to the second axis (BB'). Further disclosed are a leg rest comprising a top component, a stand and a dual-axis adjustment device, and a method of manufacturing a dual-axis adjustment device.

16 Claims, 21 Drawing Sheets

ADJUSTMENT DEVICE

TECHNICAL FIELD

The present disclosure generally relates to an adjustment device, and more particularly, to a furniture adjustment device for height and tilt adjustment device for one or more furniture pieces.

BACKGROUND

Adjustment devices have been used in various types of furniture to provide a user the ability to alter one or more dimensions of a furniture piece to suit the user's needs and comfort. Typically, the user may actuate an adjustment device to alter the height and/or tilt of the furniture piece. Conventional adjustment devices usually have a pivot axis between two moving parts, such as a main mount and a reclining arm, and a separate pivot axis for unlocking a trigger for height adjustment.

However, such adjustment devices may have a relatively huge footprint which is undesirable in an environment with space constraint.

In addition, parts of conventional adjustment devices may be stamped or cut from sheet metals which are restricted in dimensions by the manufacturing process. This would limit one or more mechanical features of a conventional adjustment device to certain dimensions and/or placement with the furniture piece.

Accordingly, there exists a need for an improved furniture adjustment device that seeks to address at least one of the aforementioned issues. Furthermore, other desirable features and characteristics will become apparent from the subsequent detailed description and the appended claims, taken in conjunction with the accompanying drawings and this background of the disclosure.

SUMMARY

According to an aspect of the disclosure, there is provided a dual-axis adjustment device comprising a pivoting component configured to allow a first (top) component of a furniture piece to rotate about a first axis with respect to a second (stand) component, and a lock component configured to allow the top component to slide relative to the stand along a second axis (BB'). The pivoting component and the lock component are arranged along a common axis (AA'). The first axis is a rotational axis. The common axis (AA') is co-axial with the first axis and perpendicular to the second axis (BB').

In some embodiments, the pivoting component comprises a cylindrical mount, a gear lock, and a rotatable arm, the cylindrical mount shaped and dimensioned to receive the gear lock and the rotatable arm. The cylindrical mount and the gear lock may comprise a first set of gear teeth and a second set of gear teeth respectively, the first set of gear teeth operatively engageable with the second set of gear teeth.

In some embodiments, the rotatable arm is arranged to support the top component of the furniture piece, the rotatable arm configured to engage with the gear lock. In a locked position, the second set of gear teeth engages the first set of gear teeth and in an unlocked position, the second set of gear teeth disengages from the first set of gear teeth.

In some embodiments, the adjustment device further comprises a first trigger mechanism pivoted on the cylindrical mount. The gear lock comprises a slot configured to function as a cam slot. The first trigger mechanism comprises a shaft configured to function as a cam follower to engage the slot of the gear lock in a manner such as to engage or disengage the second set of gear teeth from the first set of gear teeth.

In some embodiments, the adjustment device further comprises a biasing mechanism having a first end and a second end. The first end is mounted on the rotatable arm and the second end is attached to the first trigger mechanism.

In some embodiments, the adjustment device further comprises a coil spring, the coil spring configured to provide a preloaded counter rotational motion of the rotatable arm with respect to the cylindrical mount when the gear lock is disengaged.

In some embodiments, the adjustment device further comprises a first trigger pedal, the first trigger pedal comprising a handle and an engagement portion to engage the first trigger mechanism in a manner such as to rotate the first trigger mechanism.

In some embodiments, the lock component comprises a linkage arm, a connector and a rod. The rod is pivotably connected to the connector. The linkage arm is configured to provide an upward force on the rod.

In some embodiments, the adjustment device further comprises a mounting arm. The mounting arm is arranged to support the top component of the furniture piece.

In some embodiments, the adjustment device further comprises a second trigger mechanism. The mounting arm comprises a slot configured to function as a cam slot. The second trigger mechanism comprises a shaft configured to function as a cam follower to engage the slot of the mounting arm in a manner such as to rotate the linkage arm about a pivot on the mounting arm.

In some embodiments, the adjustment device further comprises a second trigger pedal, the second trigger pedal comprising a handle and an engagement portion to engage the second trigger mechanism in a manner such as to rotate the second trigger mechanism.

In some embodiments, the second trigger pedal remains at a constant angle with respect to the top component when the top component is rotated about the first axis with respect to the stand.

According to another aspect of the disclosure, there is provided a leg rest comprising a top component and a stand, the top component rotatably mounted to the stand about a first axis and slidable from the stand along a second axis. The leg rest comprises an adjustment device, the adjustment device comprises a pivoting component configured to allow the top component to rotate about the first axis and a lock component configured to allow the top component to slide relative to the stand along the second axis. The pivoting component and the lock component are arranged along a common axis (AA'). The first axis is a rotational axis. The common axis (AA') is co-axial with the first axis and perpendicular to the second axis (BB').

In some embodiments, the stand comprises a support and a base. The top component is attachable to the support.

In some embodiments, the support comprises an elongated housing to contain the pivoting component and the lock component therein. The elongated housing has a longitudinal axis which is the common axis (AA').

According to a third aspect of the disclosure, there is provided a method of manufacturing a dual-axis adjustment device, the method comprising a step of providing a pivoting component configured to allow a top component of a furniture piece to rotate about a first axis with respect to a stand and a step of providing a lock component configured to allow the top component to slide relative to the stand along a second axis. The pivoting component and the lock component are arranged along a common axis (AA'). The first axis is a rotational axis. The common axis (AA') is co-axial with the first axis and perpendicular to the second axis (BB').

BRIEF DESCRIPTION OF THE DRAWINGS

The disclosure will be better understood with reference to the detailed description when considered in conjunction with the non-limiting examples and the accompanying drawings, in which.

DETAILED DESCRIPTION

Figure 1:
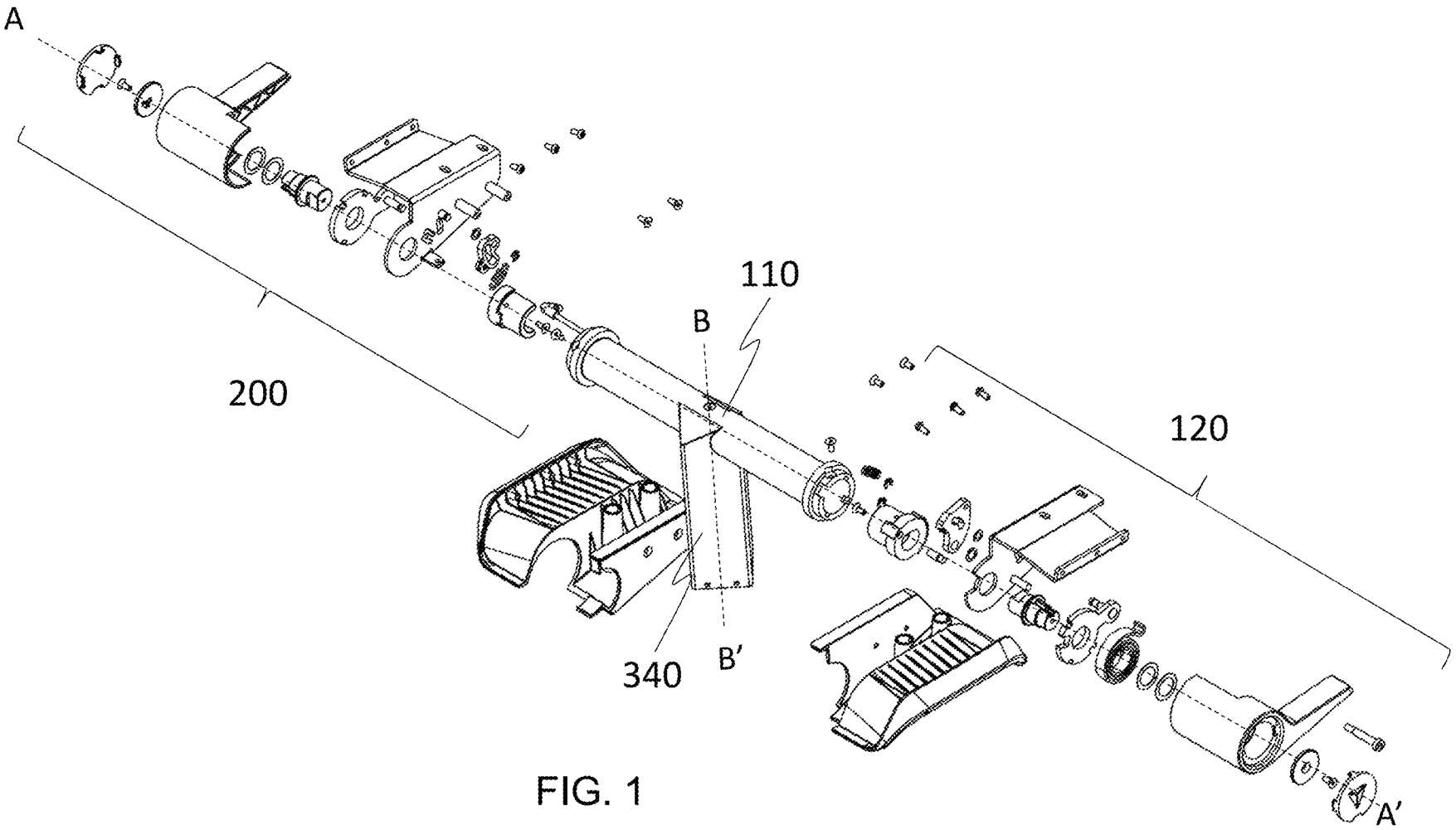
FIG. 1 is an exploded perspective view of a dual-axis adjustment device, according to an embodiment.

The following detailed description refers to the accompanying drawings that show, by way of illustration, specific details and embodiments in which the disclosure may be practiced. These embodiments are described in sufficient detail to enable those skilled in the art to practice the disclosure. Other embodiments may be utilized and structural, and logical changes may be made without departing from the scope of the disclosure. The various embodiments are not necessarily mutually exclusive, as some embodiments can be combined with one or more other embodiments to form new embodiments.

The disclosure illustratively described herein may suitably be practiced in the absence of any element or elements, limitation or limitations, not specifically disclosed herein. Thus, for example, the terms "comprising", "including," containing", etc. shall be read expansively and without limitation. The word "comprise" or variations such as "comprises" or "comprising" will accordingly be understood to imply the inclusion of a stated integer or groups of integers but not the exclusion of any other integer or group of integers. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the disclosure. Thus, it should be understood that although the present disclosure has been specifically described in exemplary embodiments and optional features, modification and variation of the disclosure embodied herein may be resorted to by those skilled in the art.

Features that are described in the context of an embodiment may correspondingly be applicable to the same or similar features in the other embodiments. Features that are described in the context of an embodiment may correspondingly be applicable to the other embodiments, even if not explicitly described in these other embodiments. Furthermore, additions and/or combinations and/or alternatives as described for a feature in the context of an embodiment may correspondingly be applicable to the same or similar feature in the other embodiments.

In the context of various embodiments, the articles "a", "an" and "the" as used with regard to a feature or element include a reference to one or more of the features or elements. As used herein, the term "and/or" includes any and all combinations of one or more of the associated listed items.

While terms such as "first", "second" etc., may be used to describe various elements, such elements are not limited to the above terms. The above terms are used only to distinguish one element from another, and do not define an order and/or significance of the elements unless explicitly stated. Without departing a scope of rights of the specification, a first element may be referred to as a second element, and similarly, the second element may be referred to as the first element.

It should be understood that the terms "on", "over", "top", "bottom", "down", "side", "back", "left", "right", "front", "lateral", "side", "up", "down" etc., when used in the following description are used for convenience and to aid understanding of relative positions or directions, and not intended to limit the orientation of any device, structure or any part of any device or structure.

As used herein, the term "coupled" (or "connected") herein may be understood as mechanically coupled, for example attached or fixed, or just in contact without any fixation, and it will be understood that both direct coupling or indirect coupling (in other words: coupling without direct contact) may be provided.

As used herein, the term "furniture" refers broadly to objects intended to support various human activities such as sitting, working, resting, lying, and/or for putting things on or in. Furniture may include, but not limit to, tables, chairs, desks, sofas, stools, leg rests, footrests and/or cabinets, required for use and/or ornament in a house, office and/or other similar environments. The term "furniture piece" can refer to a part, a unit of the furniture, or a portion thereof.

As used herein, the term "pivot" may be understood as a pin, point, short shaft or any similar means of supporting an object that rests and turns and/or allowing the object to rotate or spin around on it.

In order that the disclosure may be readily understood and put into practical effect, various embodiments will now be described by way of examples and not limitations, and with reference to the figures.

According to an aspect of the disclosure, there is a dual-axis adjustment device, comprising a pivoting component configured to allow a first component of a furniture or furniture piece, which may be a top component of the furniture piece, to rotate about a first axis with respect to a second component of the furniture, which may be a stand. The dual-axis adjustment device may comprise a lock component, the lock component configured to allow the top component to slide relative to the stand along a second axis (BB'), wherein the pivoting component and the lock component are arranged along a common axis (AA'), the first axis is a rotational axis or axis of rotation, and wherein the common axis (AA') is co-axial with the first axis and perpendicular to the second axis (BB'). When a user actuates the adjustment device to rotate the top component about the first axis with respect to the stand, both the pivoting component and the lock component are maintained at the common axis (AA') as they rotate along the first axis. On the other hand, when the user actuates the adjustment device to slide the top component relative to the stand along the second axis (BB'), both the pivoting component and the lock component are maintained at the common axis (AA') as they move along the second axis. The placement of the pivoting component and the lock component on the common axis (AA') reduces the footprint or form factor of both components in the adjustment device, which in turn reduces the footprint of the adjustment device. Therefore, the user may require relatively less space to accommodate a furniture piece with the adjustment device of the present disclosure as compared a furniture piece with a conventional adjustment device.

FIG. 1 shows an embodiment of an adjustment device 100 which includes a pivoting component 120, a lock component 200 and a collar 110. The pivoting component 120, the lock component 200 and the collar 110 are arranged along a common axis (AA'). The collar 110 may comprise a tubular portion, the tubular portion having a hollow internal shaped and dimensioned to receive at least a portion of the pivoting component 120 and at least a portion of the lock component 200.

The pivoting component 120 allows a user to adjust a tilt angle of a furniture piece by causing the furniture piece to rotate about the first axis.

The lock component 200 allows the user to adjust a height of the furniture piece by causing the furniture piece to slide relative to or along the second axis.

The collar 110 may be configured to receive a portion of the pivoting component 120 and/or a portion of the lock component 200. From another perspective, the pivoting component 120 and/or the lock component 200 may be configured to fasten to the collar 110. A fastener may provide permanent or temporary fastening, and includes, for example, a screw, a bolt, a stud or any similar means of fastening. The collar 110 may be used to synchronize movement between the pivoting component 120 and the lock component 200. The collar 110 may comprise means for attaching to the stand 340 or one or more other furniture pieces. The stand 340 or the one or more other furniture pieces may lie along a second axis (BB') such that the common axis (AA') is substantially perpendicular to the second axis (BB'). The collar 110 may contain the point of intersection between the common axis (AA') and the second axis (BB').

In some embodiments, the collar 110 and the stand 340 may comprise at least two or more parts. The two or more parts may be combined via various fastening mechanisms such as one or more snap-fit arrangements, one or more connecting flanges, one or more nuts and bolts, etc.

In some embodiments, the collar 110 and stand 340 may be integrally molded.

Figure 2:
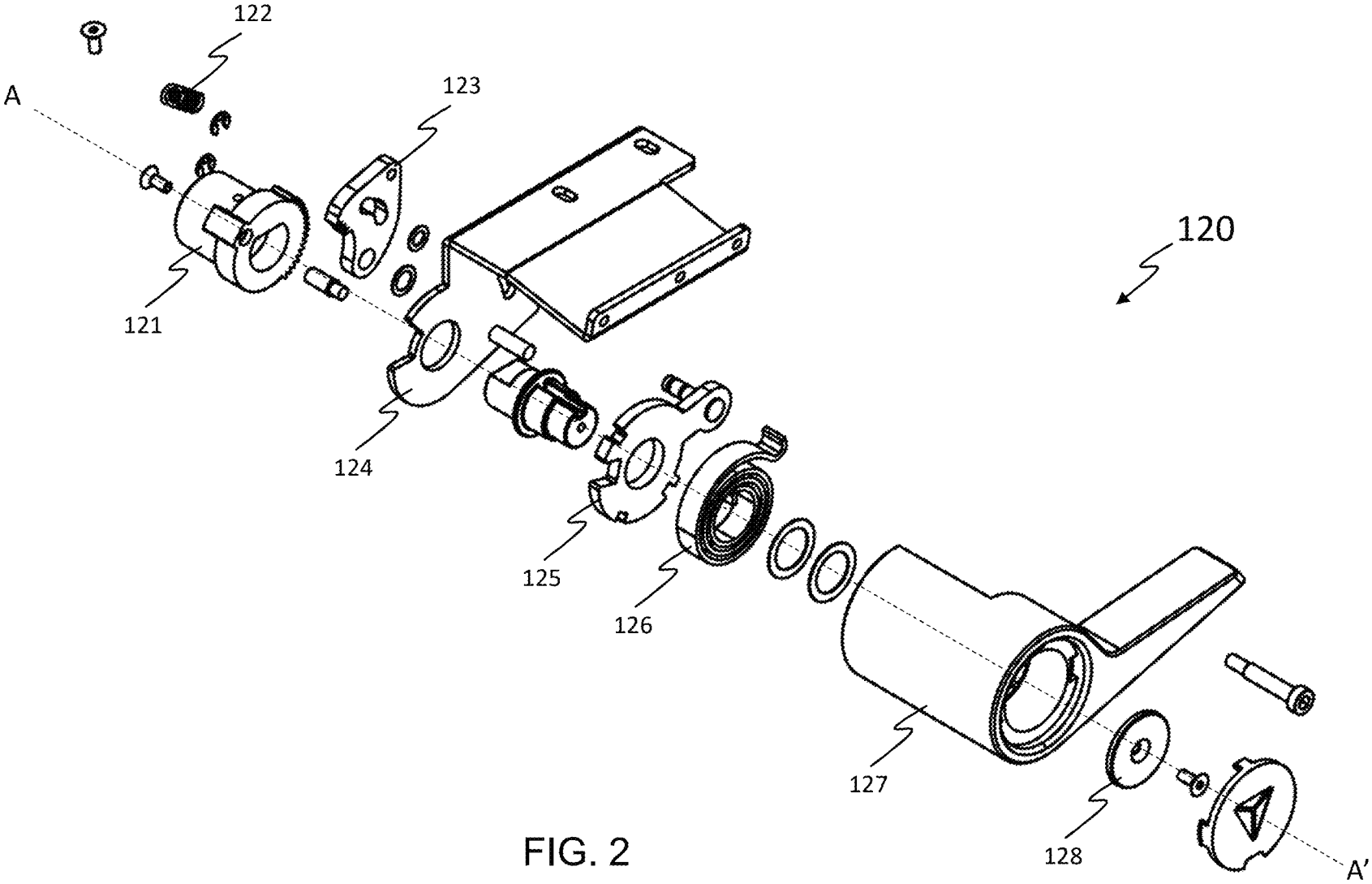
FIG. 2 is an exploded perspective view of an embodiment of a pivoting component of the adjustment device.

FIG. 2 provides an exploded perspective view of an embodiment of the pivoting component 120. The pivoting component 120 includes a cylindrical mount 121, a gear lock 123, a rotatable arm 124, a first trigger mechanism 125, a coil spring 126, a biasing mechanism 122, a first trigger pedal 127 and a first sleeve 128. The cylindrical mount 121 may be shaped and dimensioned to receive the gear lock 123 and the rotatable arm 124.

Figure 3A:
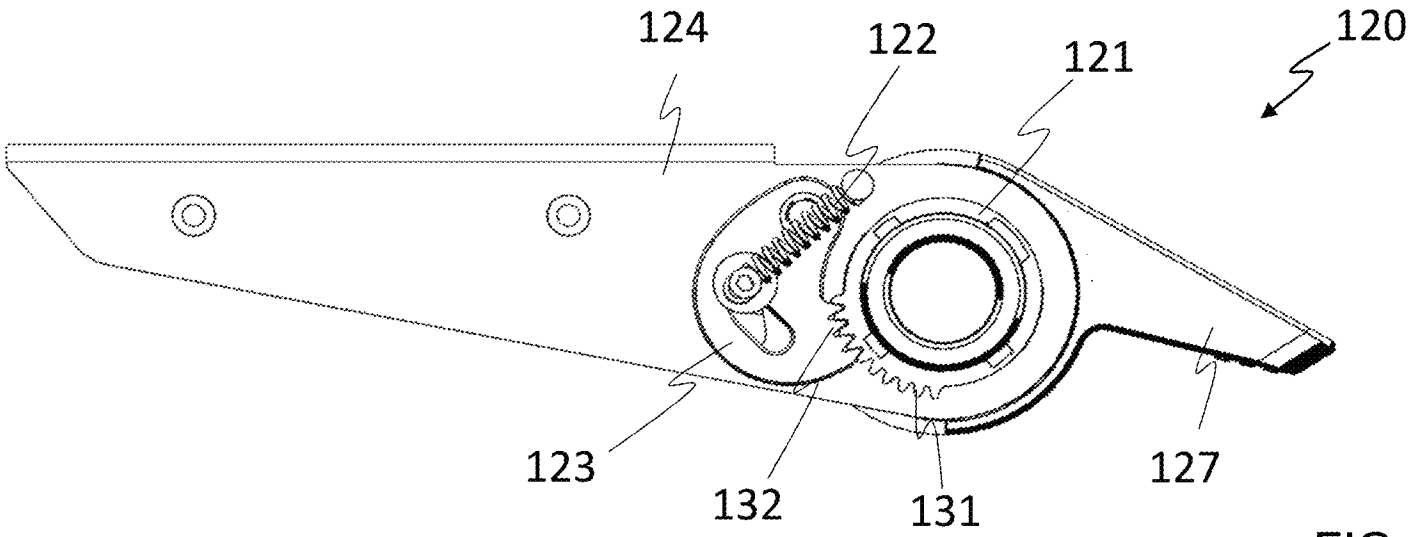
FIG. 3A is a side view of an embodiment of the pivoting component with a cylindrical mount having a first set of gear teeth and a gear lock having a second set of gear teeth, the first set of gear teeth and the second set of gear teeth in a locked position when a first trigger pedal is untriggered.
Figure 3B:
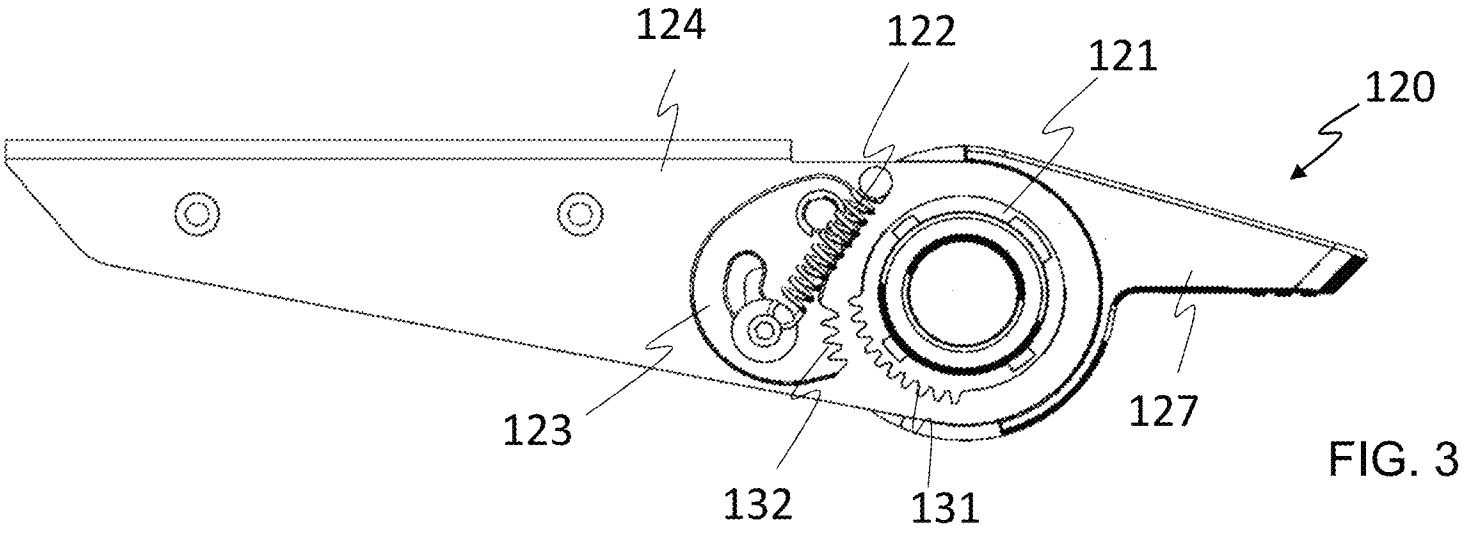
FIG. 3B is a side view of the pivoting component of FIG. 3A with the first set of gear teeth and the second set of gear teeth in an unlocked position when the first trigger pedal is triggered.

FIGS. 3A and 3B illustrate an embodiment of the pivoting component 120 comprising the cylindrical mount 121, the gear lock 123 and the biasing mechanism 122. The cylindrical mount 121 and the gear lock 123 may comprise a first set of gear teeth 131 and a second set of gear teeth 132 respectively. The first set of gear teeth 131 may be operatively engageable with the second set of gear teeth 132. The rotatable arm 124 may be arranged to support one or more parts of the furniture piece, such as a top component.

FIG. 3A shows that when the first trigger pedal 127 is untriggered, the rotatable arm 124 may be configured to engage with the gear lock 123 in a locked position, such that the second set of gear teeth 132 engages the first set of gear teeth 131. On the other hand, FIG. 3B depicts the scenario when the first trigger pedal 127 is triggered, causing the rotatable arm 124 to engage with the gear lock 123 in an unlocked position where the second set of gear teeth 132 disengages from the first set of gear teeth 131.

The engaging and/or disengaging of the second set of gear teeth 132 from the first set of gear teeth 131 may be fulfilled by the present disclosure in the following manner. The first trigger pedal 127 may comprise a handle and an engagement portion to engage the first trigger mechanism 125 in a manner such as to rotate the first trigger mechanism 125. In this case, the first trigger pedal 127 may be pivotably connected to the cylindrical mount 121.

When the user triggers the first trigger pedal 127 by rotating the handle about the first axis, the engagement portion which is engaged with the first trigger mechanism 125 would rotate along with the handle. Due to the connection with the engagement portion, the first trigger mechanism 125 may rotate about the first axis. The first trigger mechanism 125 may be pivotably connected to the cylindrical mount 121. The gear lock 123 may include a slot configured to function as a cam slot, and the first trigger mechanism 125 may include a shaft configured to function as a cam follower to engage the slot of the gear lock 123. The movement of the cam follower in the cam slot would engage and/or disengage the second set of gear teeth 132 from the first set of gear teeth 131.

As there comprise a single pivot axis in the adjustment device 100, the gear lock comprising the slot (i.e., cam slot) may be configured to ensure sufficient locking force to keep the gear lock 123 in the locked position when the first trigger pedal 127 is not triggered. That is, sufficient torque is applied on the cylindrical mount 121 and the gear lock 123 to interlock the first set of gear teeth 131 with the second set of gear teeth 132. For example, the cam slot may be of a C-shape.

The adjustment device 100 may comprise the biasing mechanism 122 having a first end and a second end, the first end being mounted on the rotatable arm 124 and the second end being attached to the first trigger mechanism 125. The biasing mechanism 122 ensures that the shaft of the first trigger mechanism 125 would not slip out of position easily, thus securing the cylindrical mount 121 and the gear lock 123 in the lock position.

Conventionally, parts of the adjustment device are commonly stamped or cut from one or more metal sheets which may limit one or more features of the adjustment device to certain dimensions. As such, for ease of assembly and for accommodating the adjustment device 100 of the present disclosure to possess only a single pivot axis, there is preferably sufficient material strength in the first set of gear teeth 131 and the second set of gear teeth 132 to lock the cylindrical mount 121 and the gear lock 123 so as to minimize relative motion between them. To address this issue, the first set of gear teeth 131, the second set of gear teeth 132, the cylindrical mount 121 and/or the gear lock 123 may be made of sintered steel, cast iron, carbon fiber or any similar means which provide sufficient material strength.

Figure 3C:
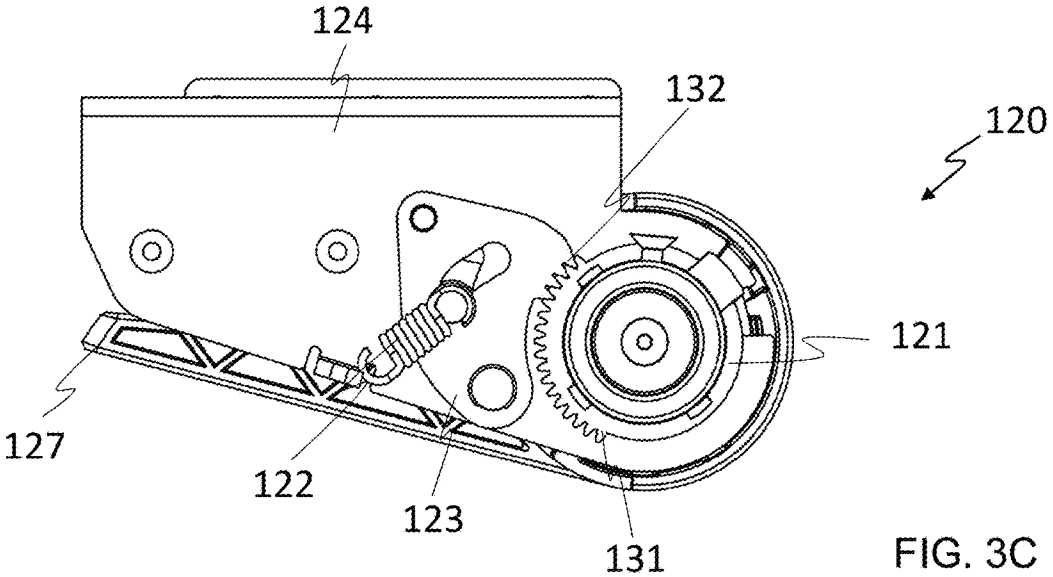
FIG. 3C is a side view of the pivoting component of FIG. 3A with the cylindrical mount having the first set of gear teeth and the gear lock having the second set of gear teeth, the first set of gear teeth and the second set of gear teeth in the locked position when the first trigger pedal is untriggered.
Figure 3D:
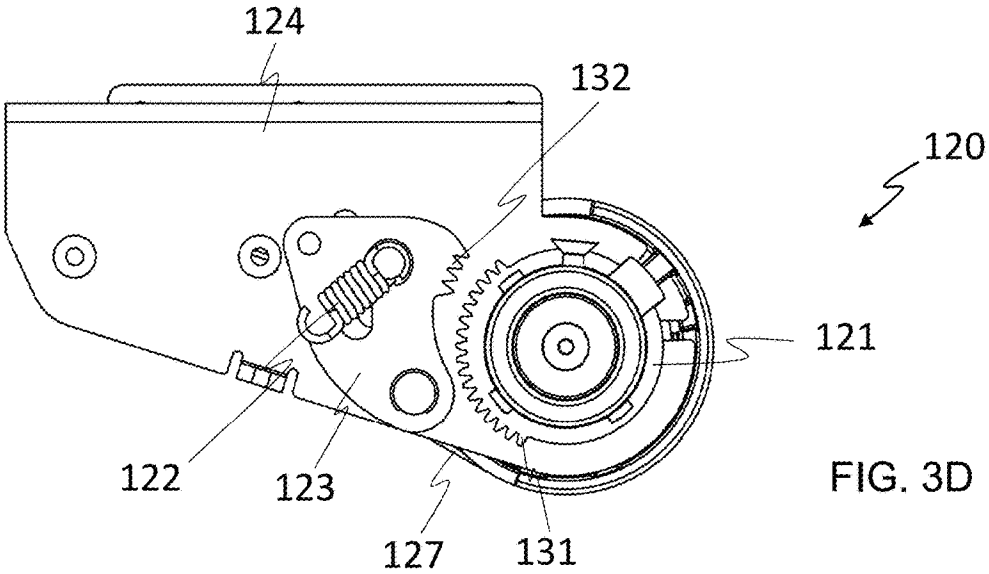
FIG. 3D is a side view of the pivoting component of FIG. 3C with the first set of gear teeth and the second set of gear teeth in the unlocked position when the first trigger pedal is triggered.

FIGS. 3C and 3D are similar to FIGS. 3A and 3B respectively but with the first trigger pedal 127 configured to be triggered by the user from the front of the pivoting component 120. This configuration allows the first trigger pedal 127 to be positioned alongside the rotatable arm 124, which reduces the footprint of the pivoting component 120 and leads to even greater space saving.

Referring back to FIG. 2, the coil spring 126 may be configured to provide a preloaded counter rotational motion of the rotatable arm 124 with respect to the cylindrical mount 121 when the gear lock 123 is disengaged. The preloaded counter rotational motion provided by the coil spring 126 prevents accidental trigger of the first trigger pedal 127.

The first sleeve 128 may serve as a plain bearing/sliding contact bearing between the cylindrical mount 121 and the first trigger pedal 127 to reduce friction and unwanted noise. In addition, one or more precision bearings may also be added to components that are rotatable, such as the rotatable arm 124 and the first trigger mechanism 125, to ensure that these components rotate in a smooth and controlled manner.

Figure 4:
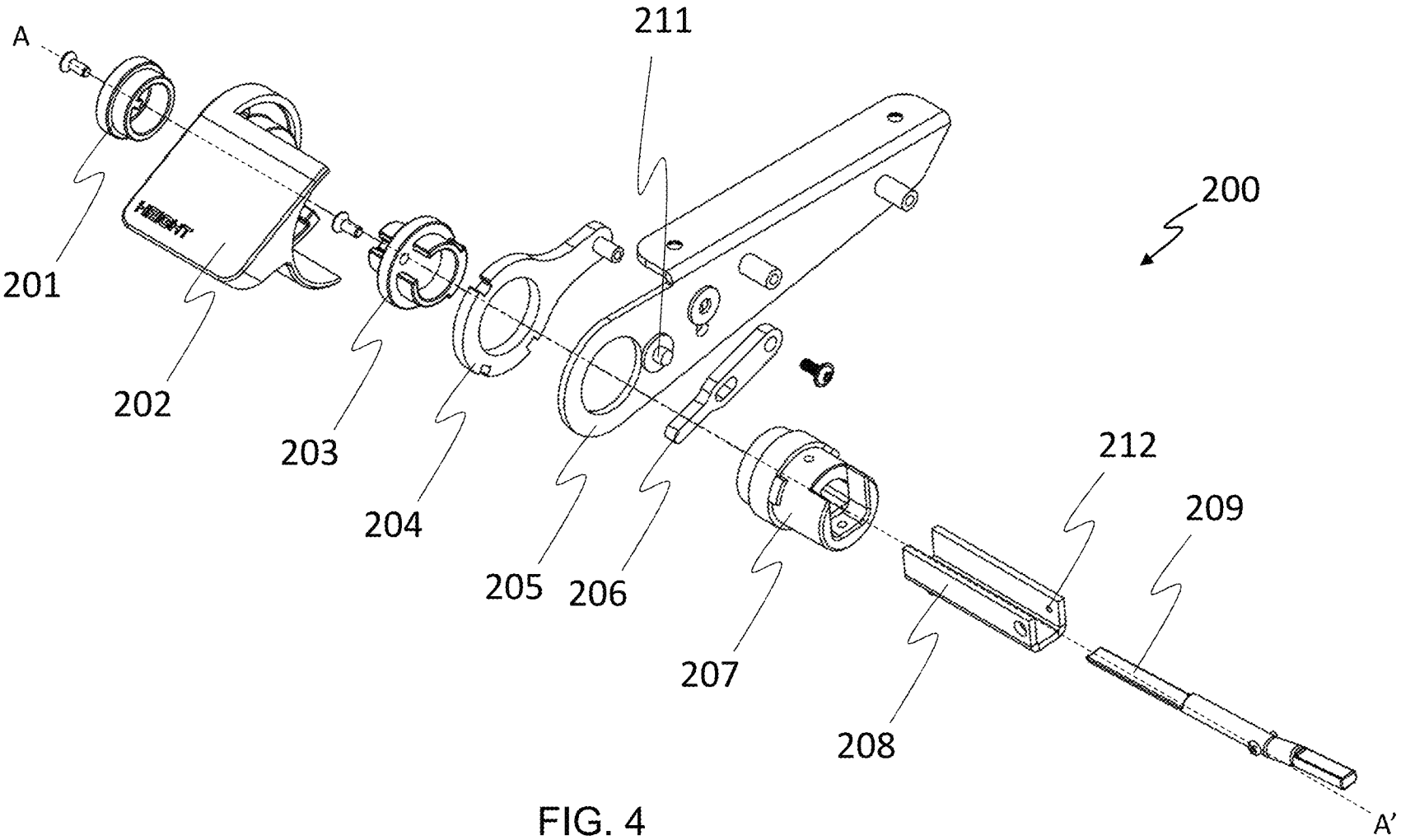
FIG. 4 is an exploded perspective view of an embodiment of a lock component of the adjustment device.

FIG. 4 provides an exploded perspective view of an embodiment of the lock component 200. The lock component 200 includes a second sleeve 201, a second trigger pedal 202, a mounting bracket 203, a second trigger mechanism 204, a mounting arm 205, a linkage arm 206, a holder 207, a connector 208 and a rod 209. The mounting arm 205 may be arranged to support one or more parts of the furniture piece, such as the top component. The rod 209 may be made of metal, metal alloy, plastic, carbon fiber or any similar materials which provide sufficient material strength for the rod 209 to transmit a force to an actuator. The actuator may include, but is not limited to, a hydraulic cylinder and/or a gas spring.

The main function of the lock component 200 is to facilitate height adjustment of the furniture piece by transmitting a force from the second trigger pedal 202 to trigger the actuator. The actuator may be situated within the stand 340 or the furniture piece. Upon triggering the actuator (e.g., pressing the trigger button/handle of the hydraulic cylinder), the furniture piece would slide relative to the stand 340 or one or more other furniture pieces along the second axis (BB'), thus extending or retracting the height of the furniture piece.

The height adjustment of the furniture piece may be fulfilled by the present disclosure in the following manner. The second trigger pedal 202 may comprise a handle and an engagement portion to engage the second trigger mechanism 204 in a manner such as to rotate the second trigger mechanism 204. The rotation of the second trigger mechanism 204 may be about a common axis (AA') which is co-axial to the first axis.

When the user triggers the second trigger pedal 202 by rotating the handle about the common axis (AA'), the engagement portion which is engaged with the second trigger mechanism 204 would rotate along with the handle. Due to the connection with the engagement portion, the second trigger mechanism 204 may also rotate about the common axis (AA'). The mounting arm 205 may comprise a slot configured to function as a cam slot. The second trigger mechanism 204 may comprise a shaft configured to function as a cam follower to engage the slot of the mounting arm 205 in a manner such as to rotate the linkage arm 206 about a pivot 211 on the mounting arm 205. The rotation of the linkage arm 206 then provides an upward force on a first end of the rod 209. As the rod 209 is pivotably connected to the connector 208 about a pivot point 212, the rod 209 exerts a downward force on the opposite end (i.e., a second end of the rod 209), which may be used to trigger the actuator (e.g., push down the trigger button of the hydraulic cylinder). The holder 207 may be configured to receive the connector 208 and/or the rod 209, for example, the connector 208 and/or rod 209 may be inserted therein through a cutout of the holder 207.

In some embodiments, the second trigger pedal 202 may be shaped in a manner similar to the first trigger pedal 127 of FIGS. 3C and 3D, such that the second trigger pedal 202 may be positioned alongside the mounting arm 205 to reduce the footprint of the lock component 200.

The actuator is adjustable as long as the second trigger pedal 202 remains triggered. Therefore, the height of the furniture piece can be adjusted so long as the second trigger pedal 202 remains triggered.

Figure 5A:
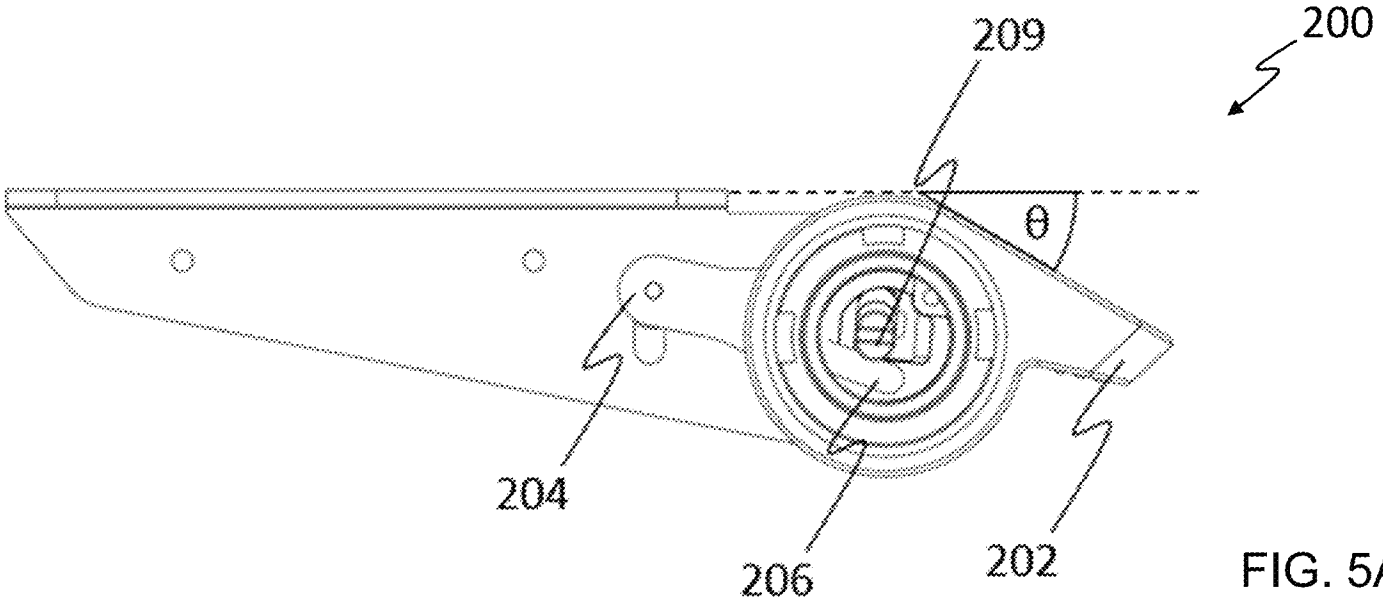
FIG. 5A is a side view of an embodiment of the lock component when the adjustment device is at a minimum tilt angle and a second trigger pedal is untriggered.
Figure 5B:
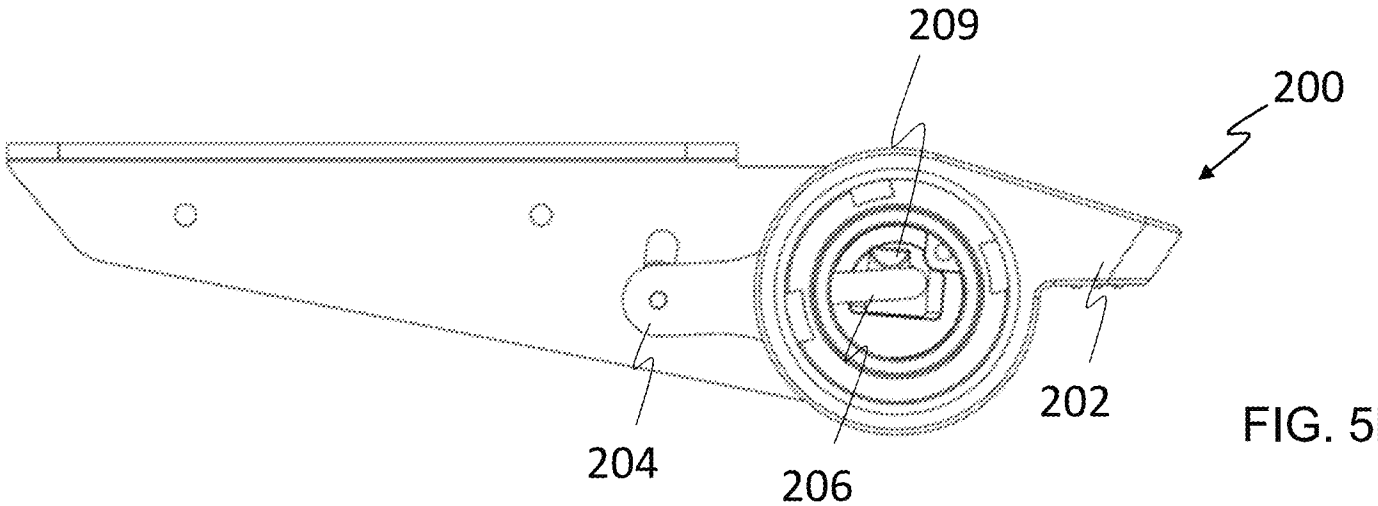
FIG. 5B is a side view of an embodiment of the lock component when the adjustment device is at the minimum tilt angle and the second trigger pedal is triggered.
Figure 6A:
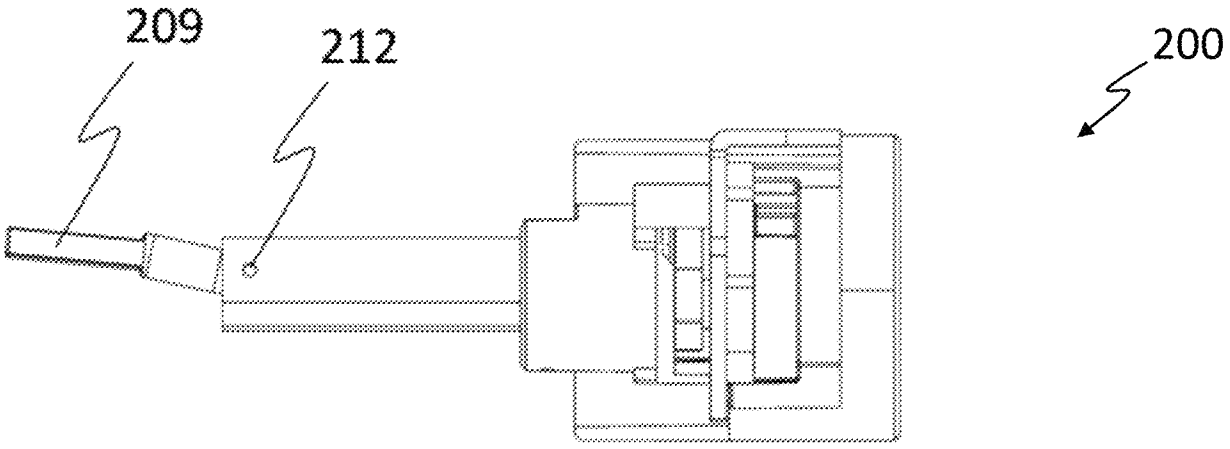
FIG. 6A is a front view of an embodiment of the lock component when the adjustment device is at the minimum tilt angle and the second trigger pedal is untriggered.
Figure 6B:
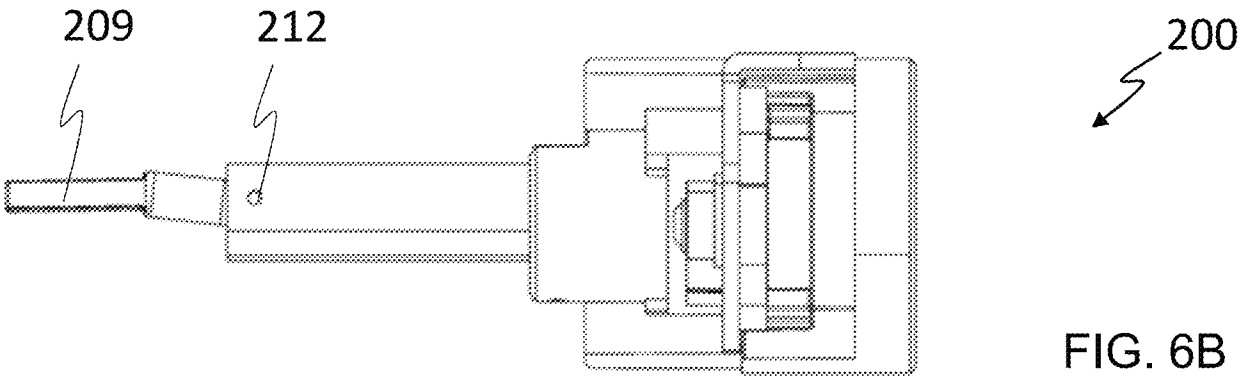
FIG. 6B is a front view of an embodiment of the lock component when the adjustment device is at the minimum tilt angle and the second trigger pedal is triggered.

FIGS. 5A, 5B, 6A and 6B show an embodiment of the lock component 200 when the adjustment device 100 is at a minimum tilt angle. In particular, FIGS. 5A and 6A depict an embodiment of the lock component 200 when the second trigger pedal 202 is untriggered. On the other hand, FIGS. 5B and 6B depict an embodiment of the lock component 200 when the second trigger pedal 202 is triggered. A comparison of these two sets of figures shows that when the second trigger pedal 202 is triggered, the rotation of the linkage arm 206 provides an upward force on the first end of the rod 209, thereby causing the second end of the rod 209 to move downward.

Figure 7A:
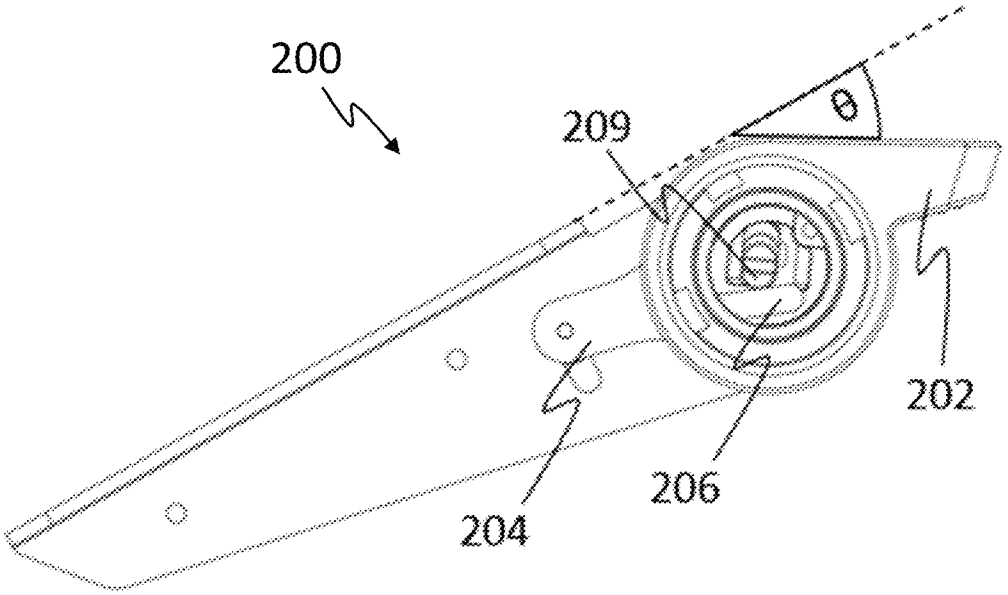
FIG. 7A is a side view of an embodiment of the lock component when the adjustment device is at a maximum tilt angle and the second trigger pedal is untriggered.
Figure 7B:
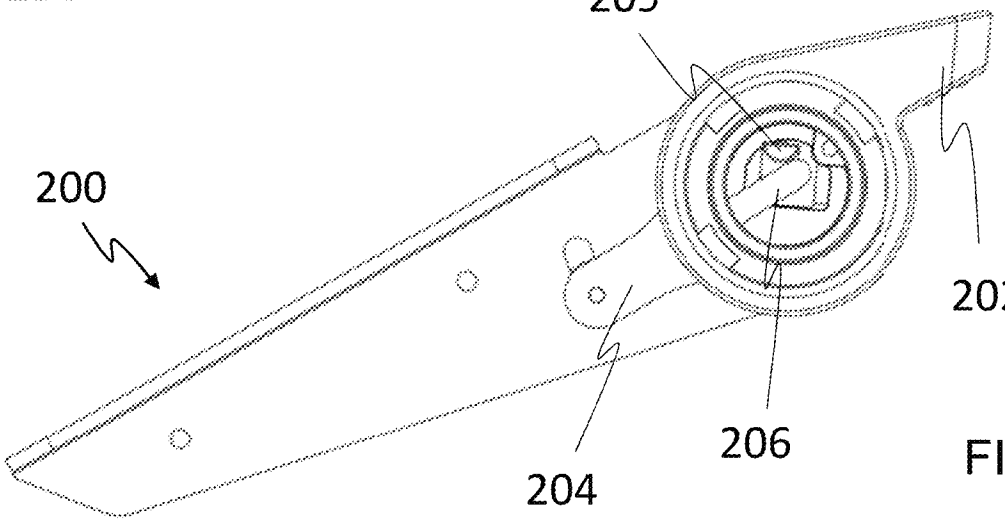
FIG. 7B is a side view of an embodiment of the lock component when the adjustment device is at the maximum tilt angle and the second trigger pedal is triggered.
Figure 8A:
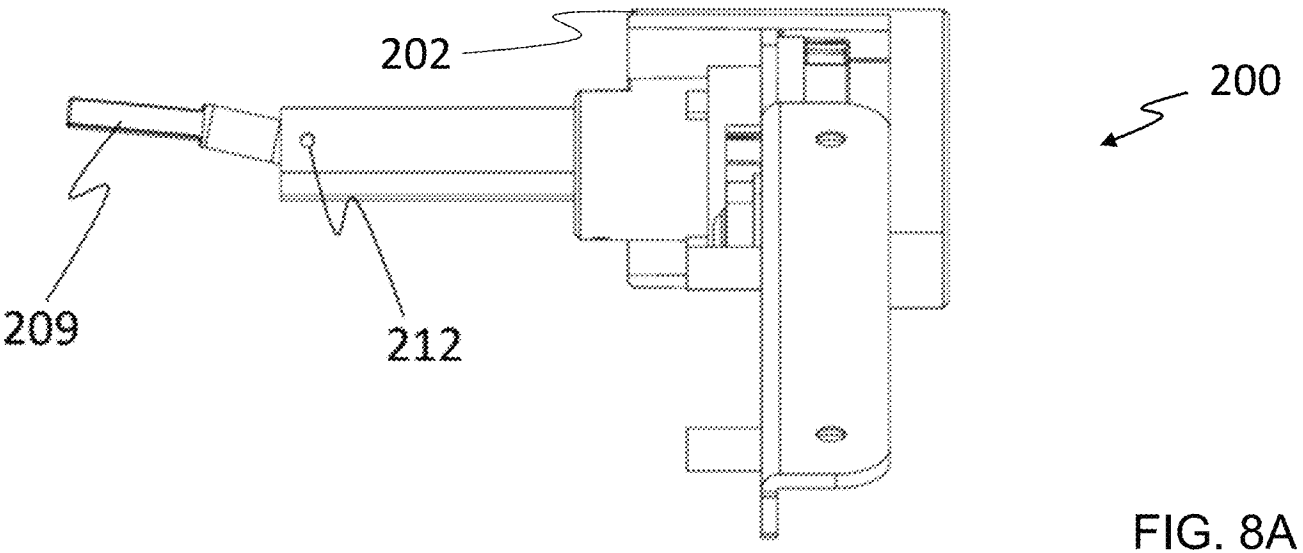
FIG. 8A is a front view of an embodiment of the lock component when the adjustment device is at the maximum tilt angle and the second trigger pedal is untriggered.
Figure 8B:
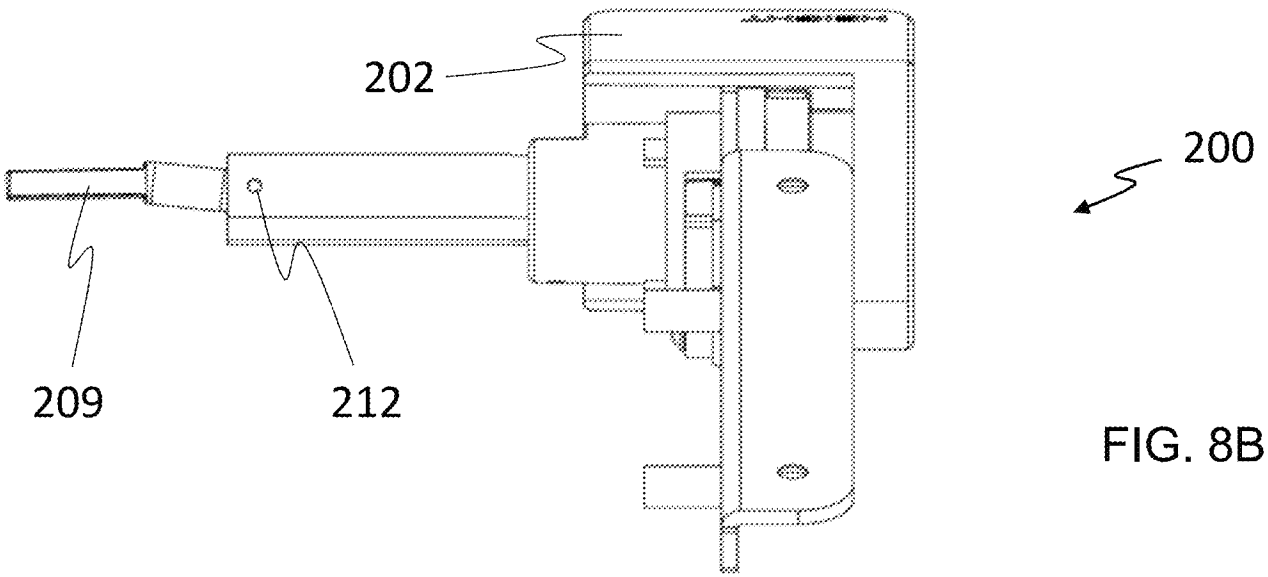
FIG. 8B is a front view of an embodiment of the lock component when the adjustment device is at the maximum tilt angle and the second trigger pedal is triggered.

FIGS. 7A, 7B, 8A and 8B show an embodiment of the lock component 200 when the adjustment device 100 is at a maximum tilt angle. In particular, FIGS. 7A and 8A depict an embodiment of the lock component 200 when the second trigger pedal 202 is untriggered. On the other hand, FIGS. 7B and 8B depict an embodiment of the lock component 200 when the second trigger pedal 202 is triggered. A comparison of these two sets of figures shows that when the second trigger pedal 202 is triggered, the rotation of the linkage arm 206 provides a force along a first direction (e.g., upward force) on the first end of the rod 209, thereby causing the second end of the rod 209 to move in a opposite direction (e.g., downward movement).

Further comparison of FIG. 5A with 7A, and FIG. 5B with 7B reveal that the only difference between the two extreme tilt angles is the interaction between the linkage arm 206 and the rod 209 such that while the linkage arm 206 and the rod 209 are always in contact, the point of contact changes according to the tilt angle of the body.

The second trigger pedal 202 makes an angle θ with respect to a portion of the furniture piece, such as the top component, when the adjustment device 100 is at the minimum tilt angle and the second trigger pedal 202 is untriggered. Conventionally, if a furniture piece has a portion mounted above an actuator and is allowed to tilt, the angle θ would not remain constant when the furniture piece is tilted at different angles. The conventional adjustment device may undesirably reduce the angle that the user is able to rotate a pedal for height adjustment (i.e., the range of angle of rotation of the pedal may be reduced) when the tilt angle of the furniture piece is not at the minimum tilt angle. This would limit the range of height adjustment provided by the adjustment device.

In contrast, the present disclosure allows the second trigger pedal 202 to remain constant at the angle θ with respect to the portion of the furniture piece when it is rotated about the first axis. That is, the angle of the second trigger pedal 202 remains constant with respect to the furniture piece (or a portion thereof) mounted above the actuator regardless of the tilt angle. Whether the furniture piece is tilted at the minimum tilt angle or at the maximum tilt angle, θ remains unchanged. The range of height adjustment provided by the adjustment device 100 would not be limited by the tilt angle of the furniture piece.

Referring back to FIG. 4, the second sleeve 201 may serve as a plain bearing between the mounting bracket 203 and the second trigger pedal 202 to reduce friction and unwanted noise. In addition, one or more precision bearings may also be added to components that are rotating, such as the mounting arm 205 and the second trigger mechanism 204, to ensure that these components rotate in a smooth and controlled manner.

Figure 9:
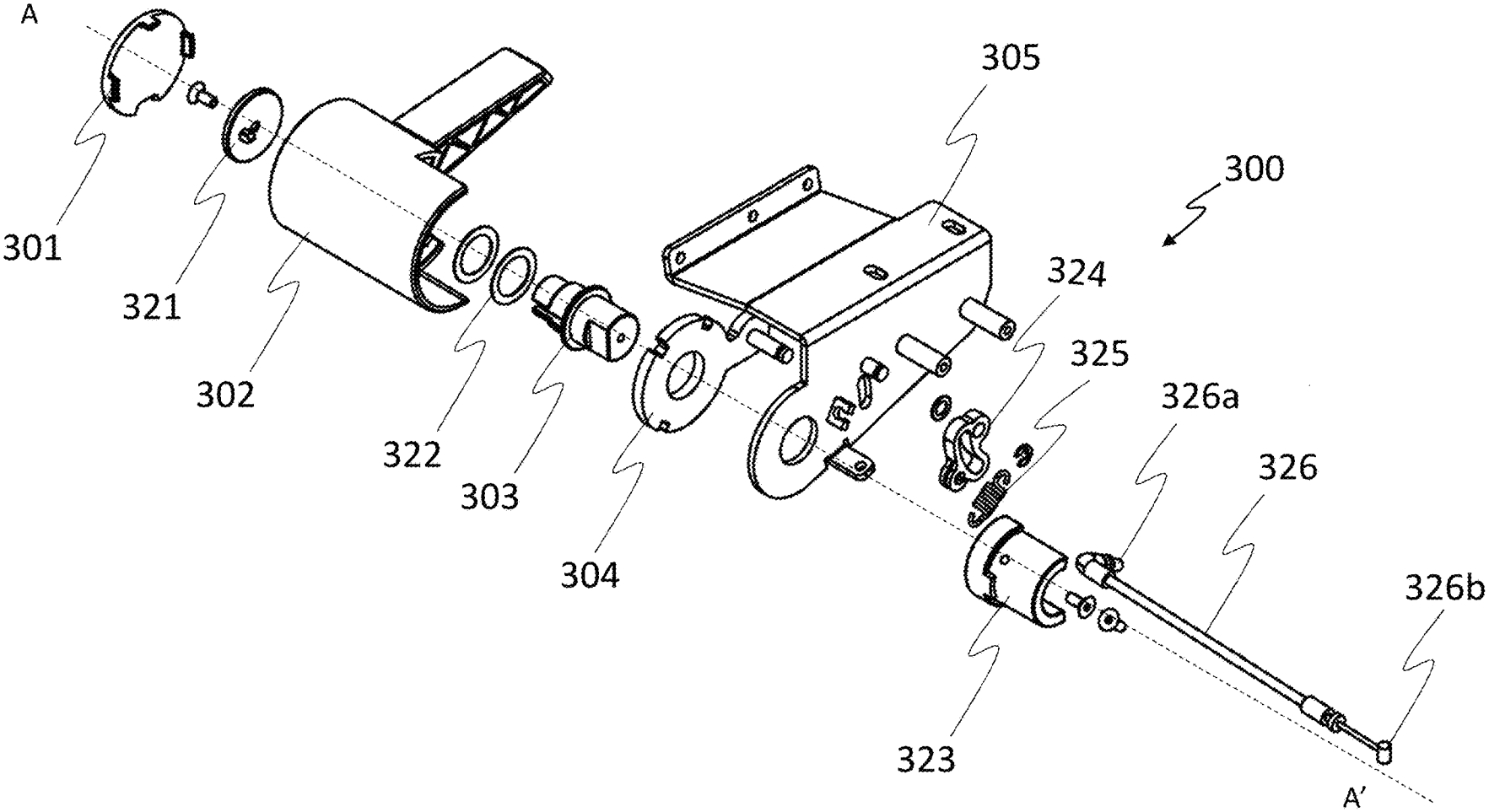
FIG. 9 is an exploded perspective view of another embodiment of the lock component of the adjustment device.

FIG. 9 provides an exploded perspective view of another embodiment of the lock component. FIG. 9 shows a lock component 300 which comprises a second sleeve 301, a second trigger pedal 302, a mounting bracket 303, a second trigger mechanism 304, a mounting arm 305, a cover 321, one or more O-rings 322, a C-shaped mount 323, a slot profile 324, a coil spring 325 and a cable 326. The description relating to the main function of the lock component 200 of FIG. 4 as described in paragraphs and may also be applicable to the lock component 300 of FIG. 9, and repetition of the description is omitted for brevity. Similarly, the description relating to the second sleeve 201, the second trigger pedal 202, the mounting bracket 203, the second trigger mechanism 204 and the mounting arm 205 of FIG. 4 may also be applicable to the second sleeve 301, the second trigger pedal 302, the mounting bracket 303, the second trigger mechanism 304 and the mounting arm 305 of FIG. 9 respectively.

Referring back to FIG. 9, the cable 326 may be made of metal, metal alloy, plastic, carbon fiber or any similar materials which provide sufficient material strength for the cable 326 to transmit a force from the mounting arm 305 to the actuator. The cable 326 may comprise a Bowden cable. In some embodiments, the cable 326 may be mounted on the mounting arm 305. For example, a sleeve of the cable 326 may be mounted into one or more grooves on the mounting arm 305. In some embodiments, the cable 326 may comprise a first end 326*a*, the first end 326*a* configured to couple to the second trigger mechanism 304 and a second end 326*b*, the second end 326*b* configured to couple to the actuator. For example, the cable 326 may comprise of a ball-shaped attachment, such as a pin, at the first end and/or the second end that couples to the actuator and/or the mounting arm 305.

In some embodiments, the C-shaped mount 323 may be shaped and dimensioned to allow the cable 326 to move/rotate without any undesirable interference with other elements of the lock component 300. The C-shaped mount 323 may allow the cable 326 to be routed within the lock component 300 without being exposed, regardless of the tilt angle of the furniture piece.

The slot profile 324 may be shaped and dimensioned to be attached onto the mounting arm 305. In some embodiments, the slot profile 324 may be shaped and dimensioned to receive the first end 326*a* of the cable 326. For example, the slot profile 324 may function as a cam slot and the first end 326*a* of the cable 326 may function as a cam follower.

The coil spring 325 may be configured to provide a preloaded counter rotational motion of the mounting arm 305 with respect to the cable 326 to prevent accidental trigger of the second trigger pedal 302.

Figure 10:
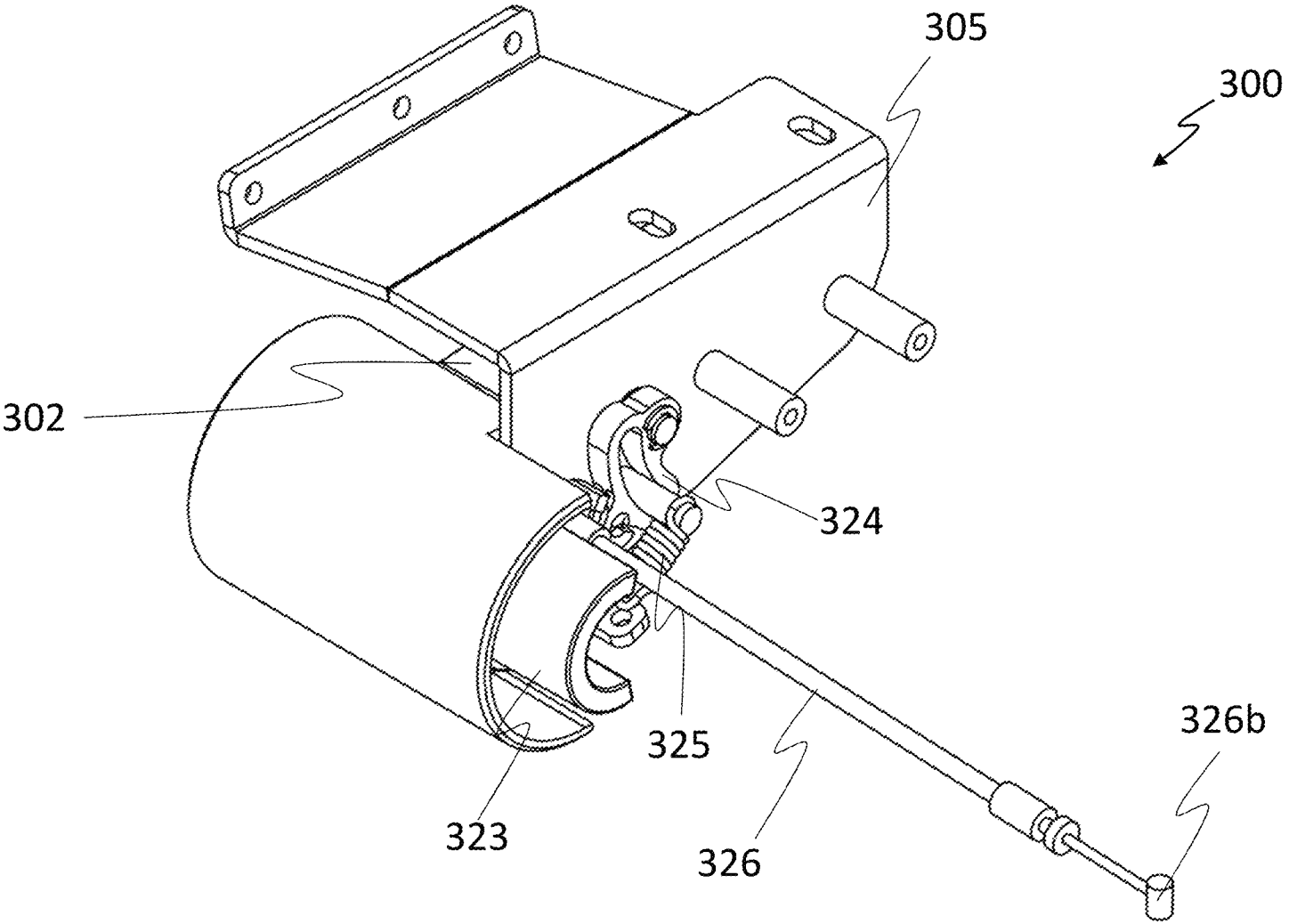
FIG. 10 is a perspective view of the lock component of FIG. 9.
Figure 11:
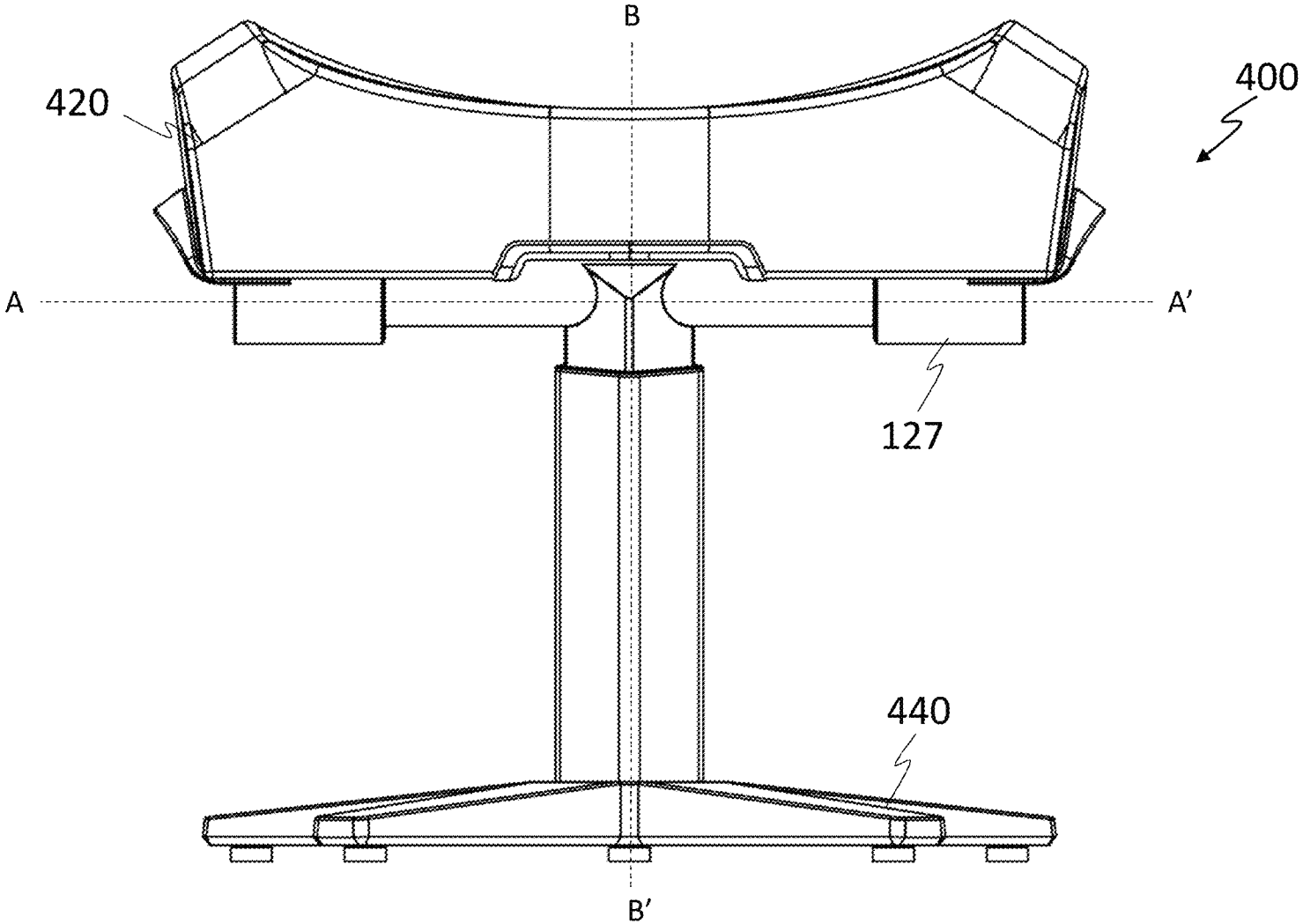
FIG. 11 is a back view of an embodiment of a leg rest with the adjustment device.
Figure 12:
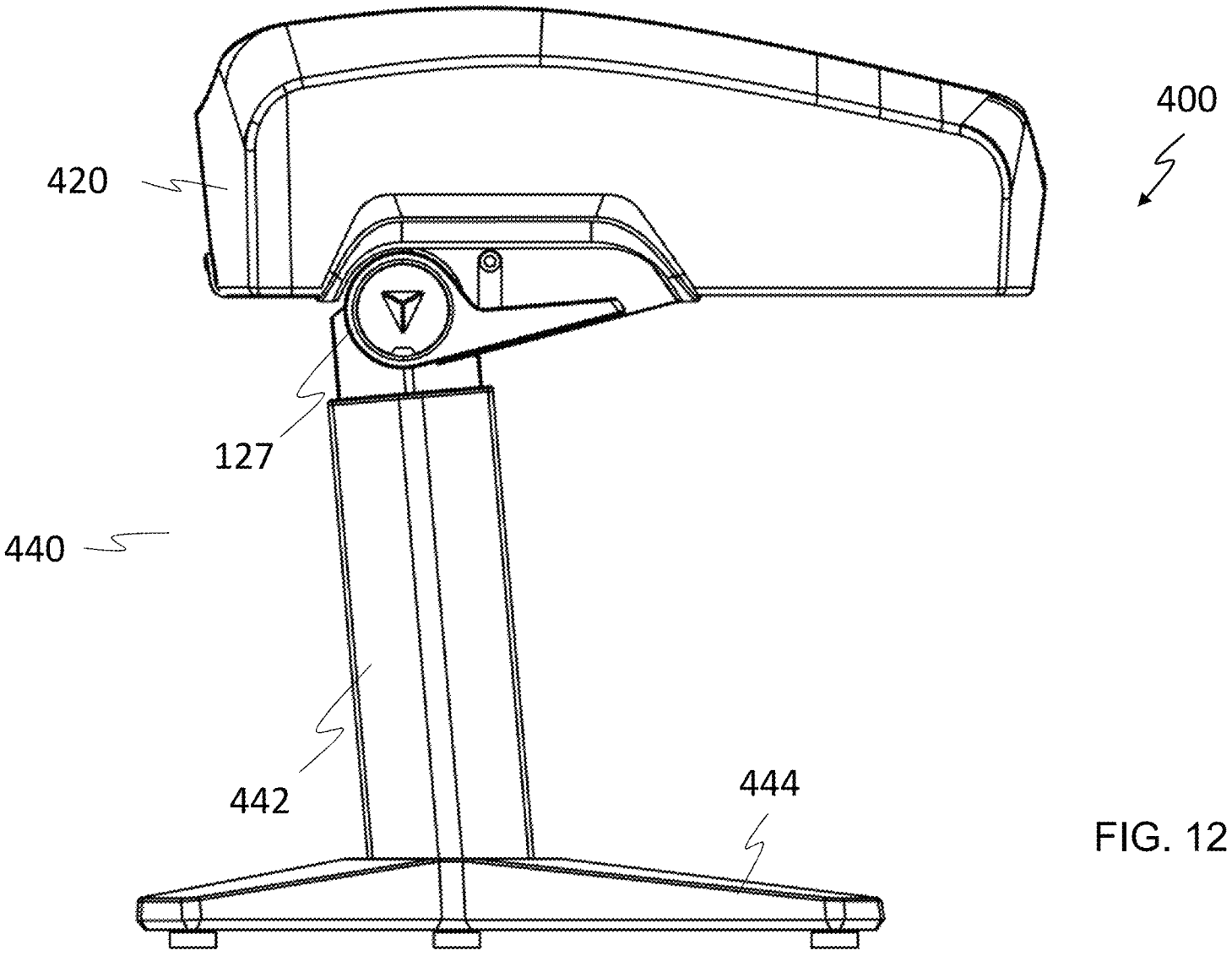
FIG. 12 is a side view of an embodiment of the leg rest with the adjustment device when the adjustment device is at the minimum tilt angle and a minimum height.
Figure 13:
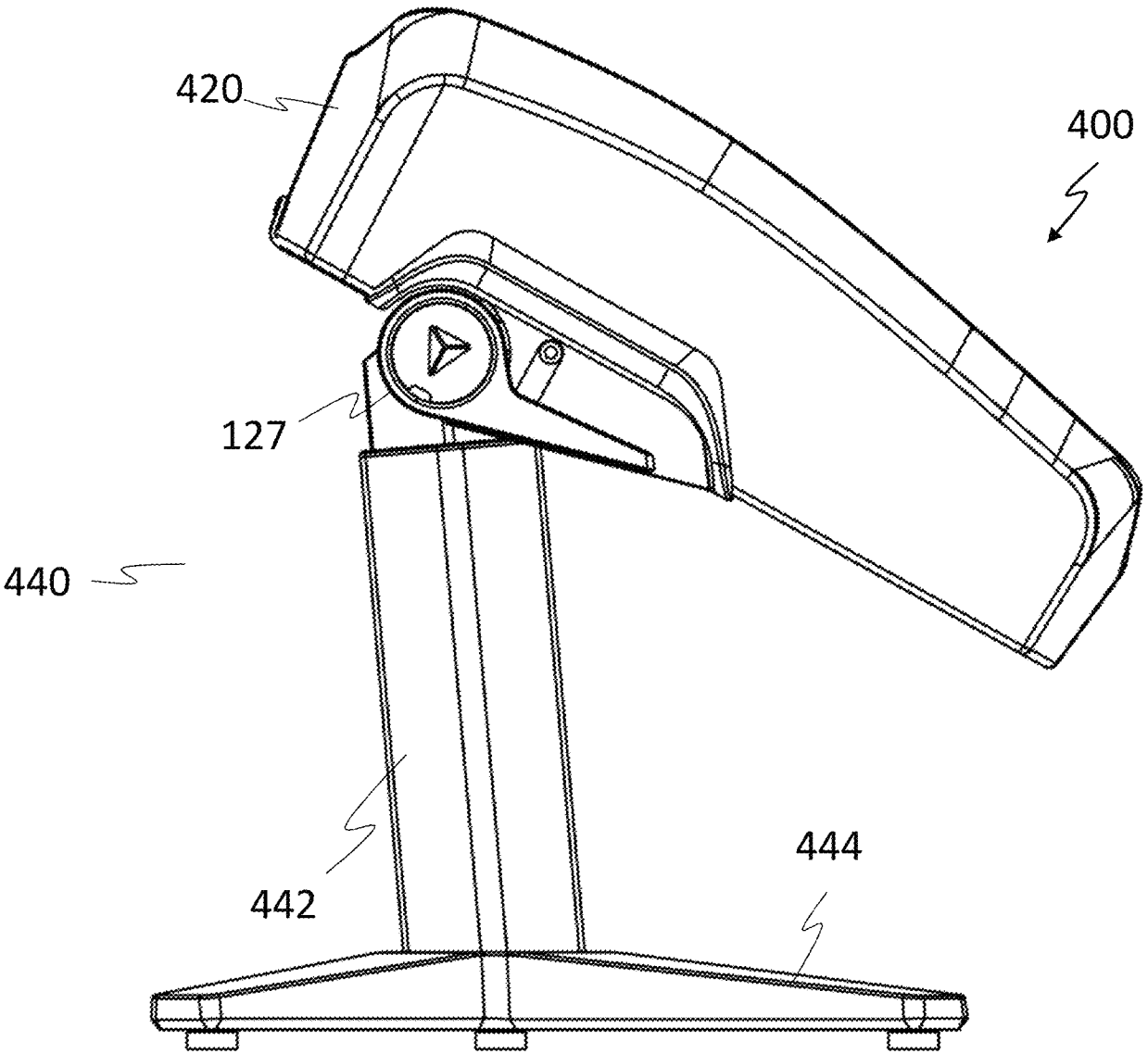
FIG. 13 is a side view of an embodiment of the leg rest with the adjustment device when the adjustment device is at the maximum tilt angle and the minimum height.
Figure 14:
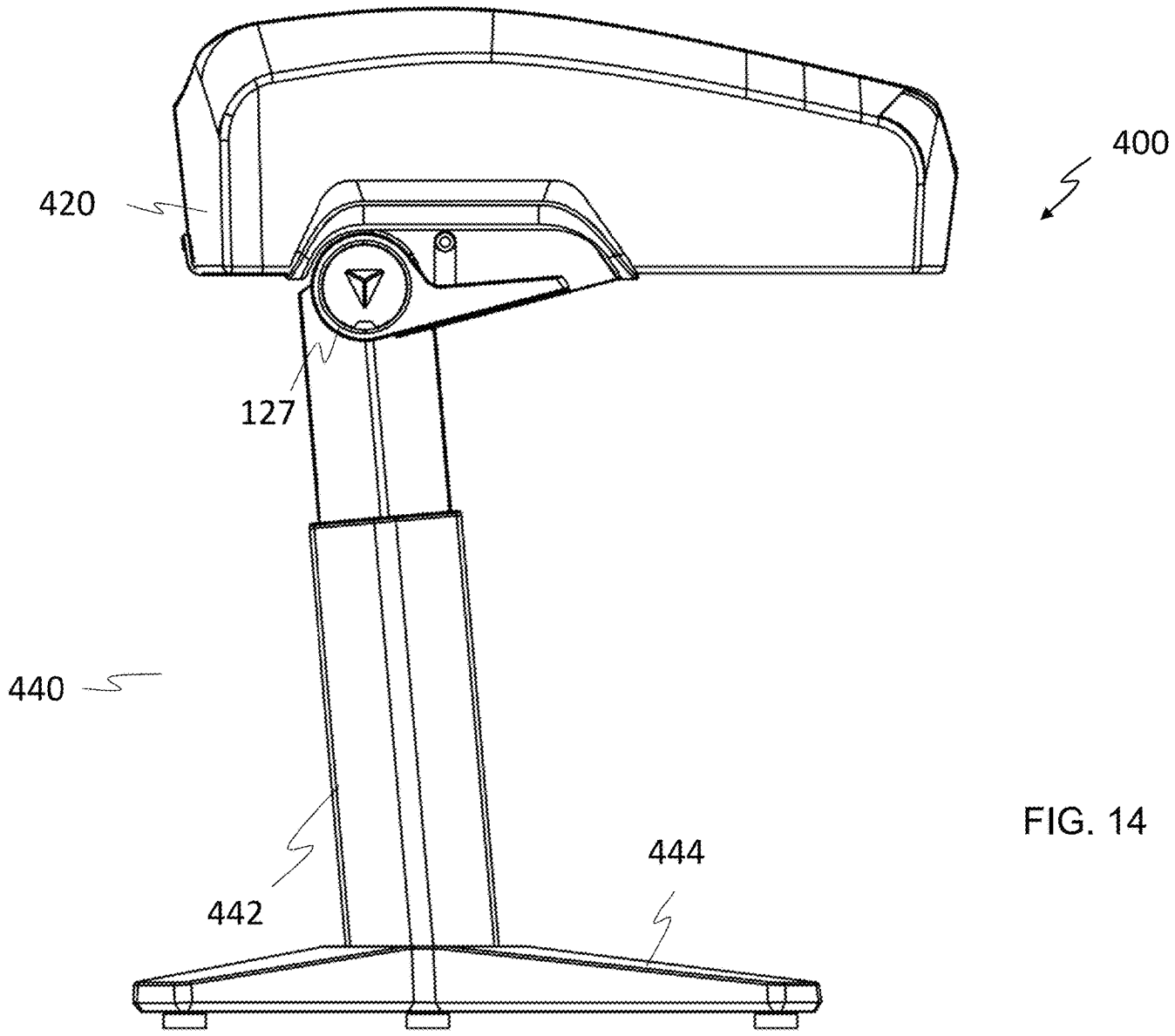
FIG. 14 is a side view of an embodiment of the leg rest with the adjustment device when the adjustment device is at the minimum tilt angle and a maximum height.
Figure 15:
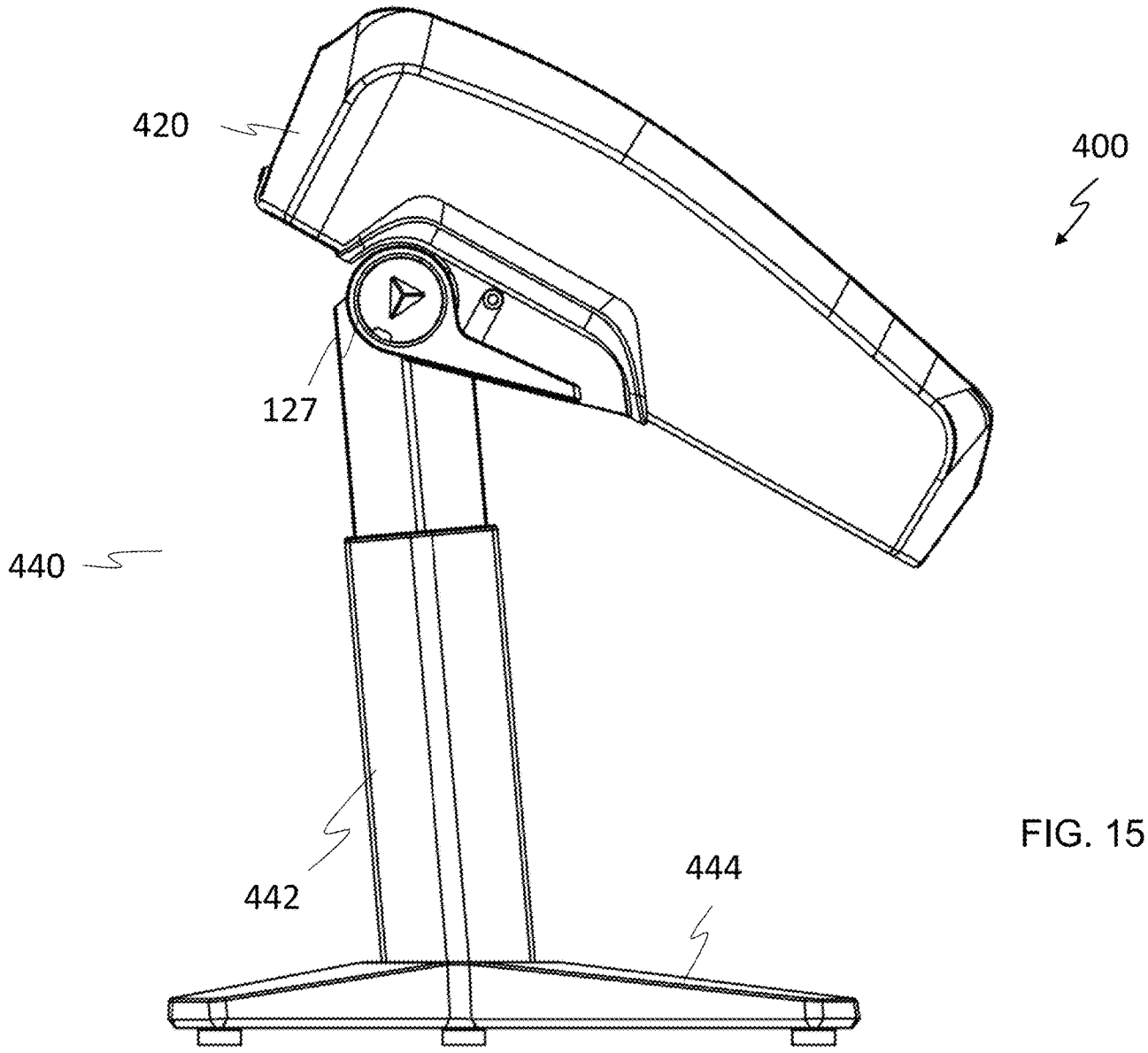
FIG. 15 is a side view of an embodiment of the leg rest with the adjustment device when the adjustment device is at the maximum tilt angle and the maximum height.
Figure 16A:
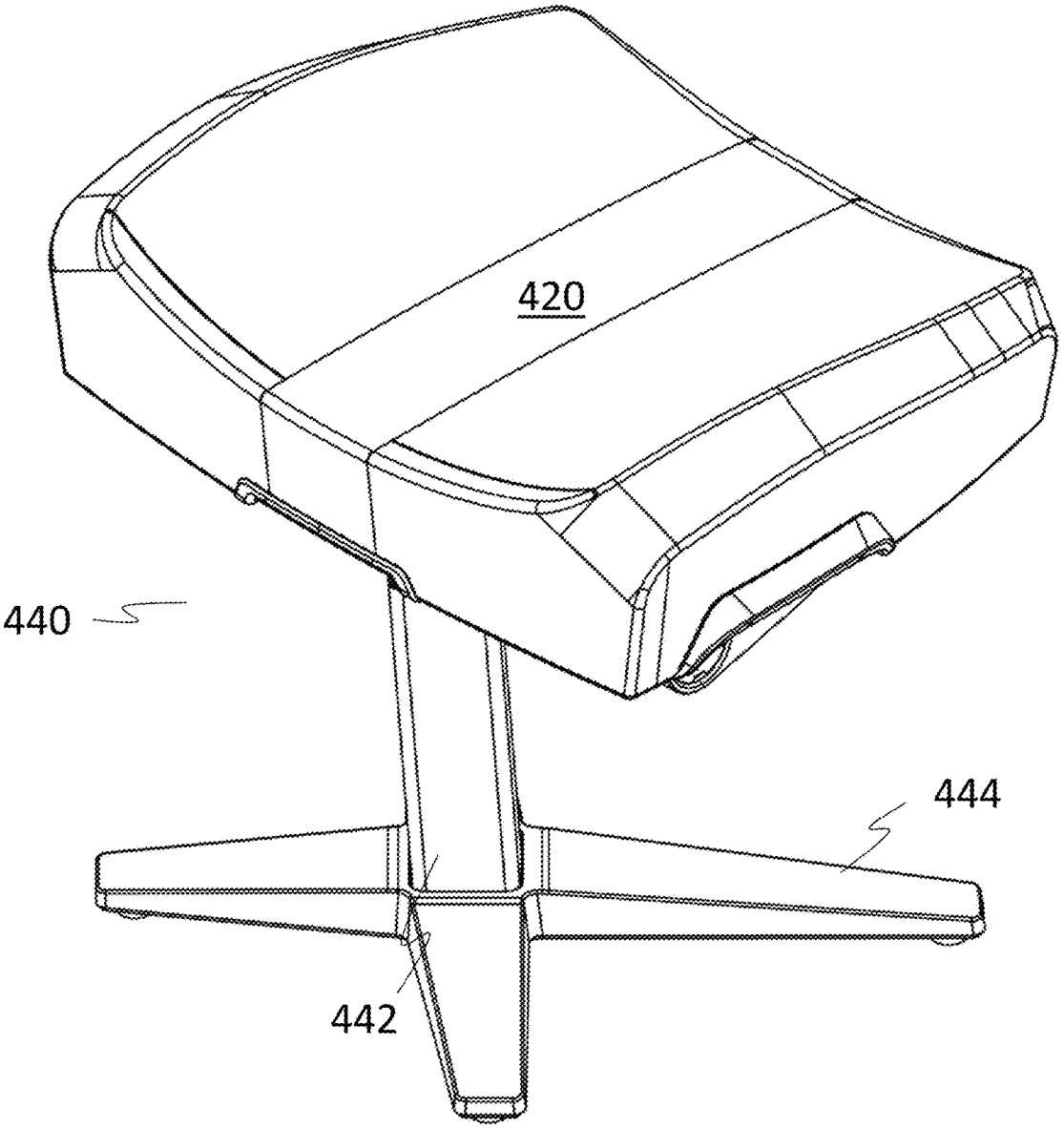
FIG. 16A is a top perspective view of an embodiment of the leg rest with the adjustment device.
Figure 16B:
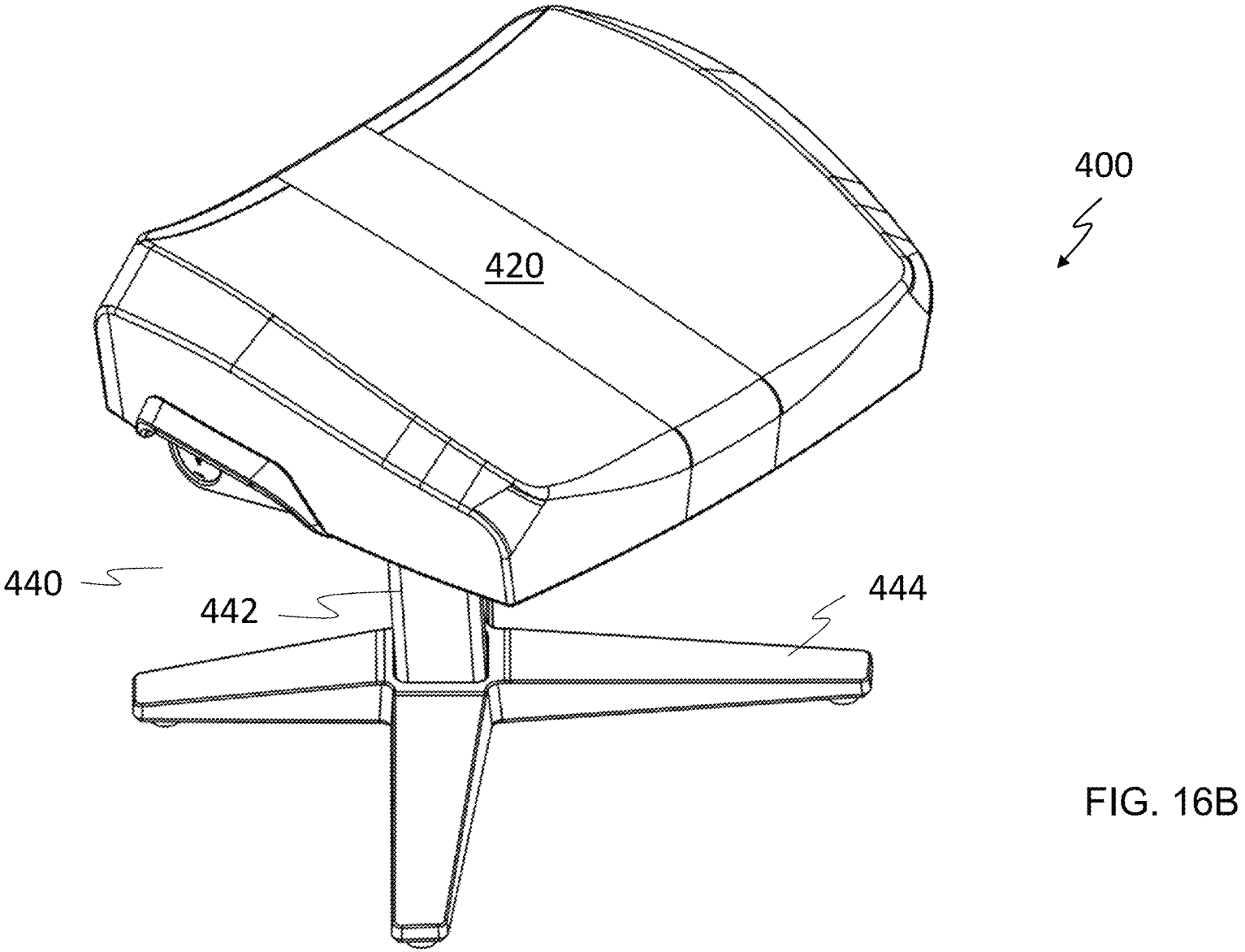
FIG. 16B is another top perspective view of the leg rest of FIG. 16A.

FIG. 10 shows a perspective view of an embodiment of the lock component 300. When the user triggers the second trigger pedal 302 by rotating the handle about the common axis (AA'), an engagement portion that is engaged with the second trigger mechanism 304 may rotate along with the handle. Due to the connection with the engagement portion, the second trigger mechanism 304 may also rotate about the common axis (AA'). The rotation of the second trigger mechanism 304 may cause the second trigger mechanism 304 to engage the first end 326*a* of the cable 326, for example, by pulling the first end 326*a* of the cable 326 such that the first end 326*a* moves along a slot in the slot profile 324, which may then translate to a pulling force on the second end of the cable 326. The pulling force on the second end 326*b* of the cable 326 may be used to trigger the actuator (e.g., pull a piston of the gas spring).

The actuator may be adjustable as the second trigger pedal 302 remains triggered. Therefore, the height of the furniture piece can be adjusted so long as the second trigger pedal 302 remains triggered.

According to another aspect of the disclosure, there is a leg rest comprising a top component and a stand, the top component rotatably mounted to the stand about a first axis and slidable from the stand along a second axis, the leg rest comprises an adjustment device. The adjustment device comprises a pivoting component configured to allow the top component to rotate about the first axis and a lock component configured to allow the top component to slide relative to the stand along the second axis. The pivoting component and the lock component are arranged along a common axis (AA'), the first axis is a rotational axis, and the common axis (AA') is co-axial with the first axis and perpendicular to the second axis (BB'). The adjustment device may refer to the adjustment device 100 described with reference to FIGS. 1 to 10 and repeated descriptions will be omitted.

FIGS. 11 to 17B show various embodiments of a leg rest 400 which includes a top component 420 and a stand 440. The stand 440 may comprise a support 442 and a base 444. The top component 420 may be attachable to the support 442. The support 442 may comprise an elongated housing to contain the collar 110, the pivoting component 120 and the lock component 200 therein, and the elongated housing has a longitudinal axis which is the common axis (AA').

Figure 17A:
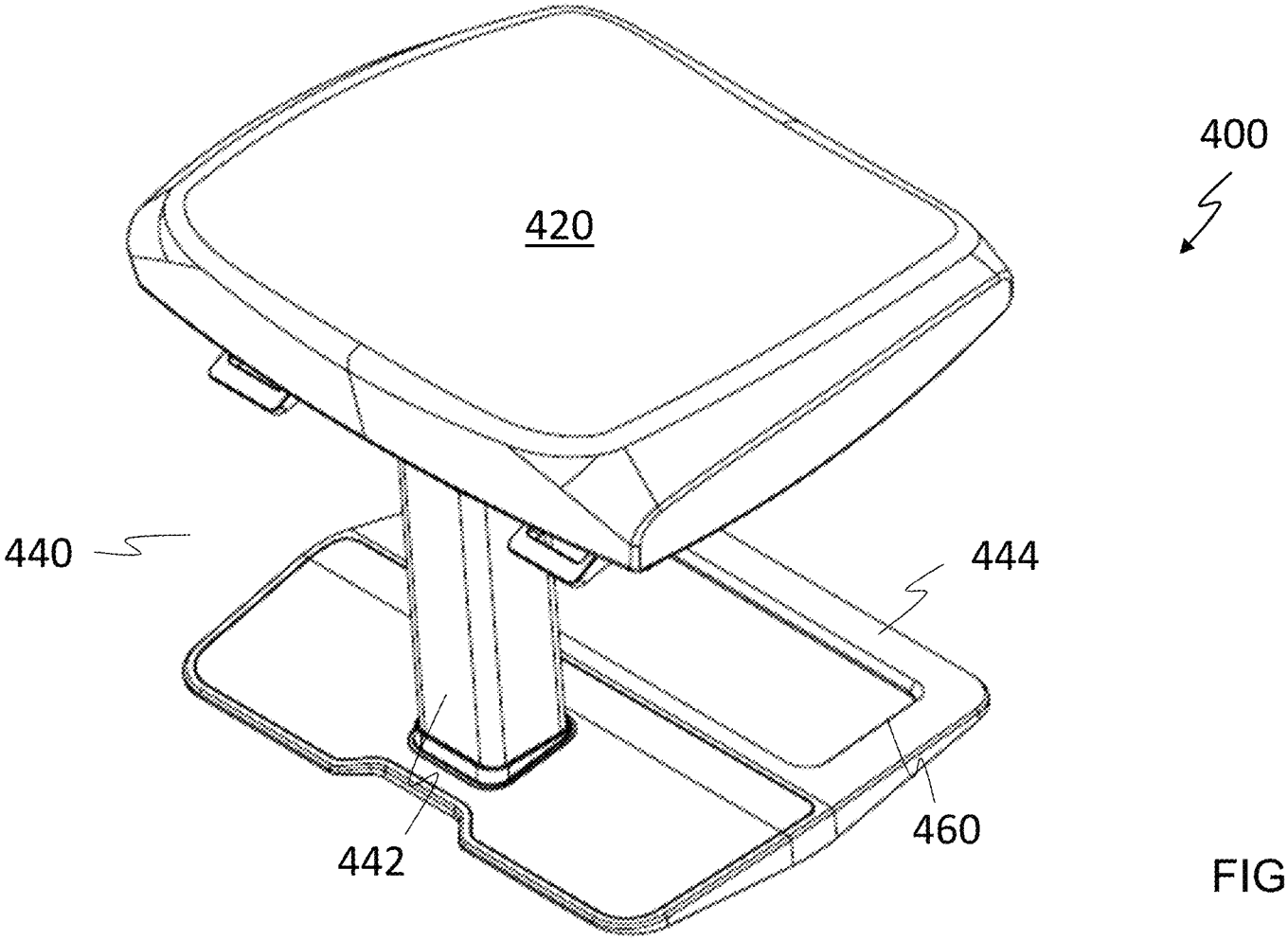
FIG. 17A is a top perspective view of an embodiment of the leg rest with the adjustment device and a base which includes a slot.
Figure 17B:
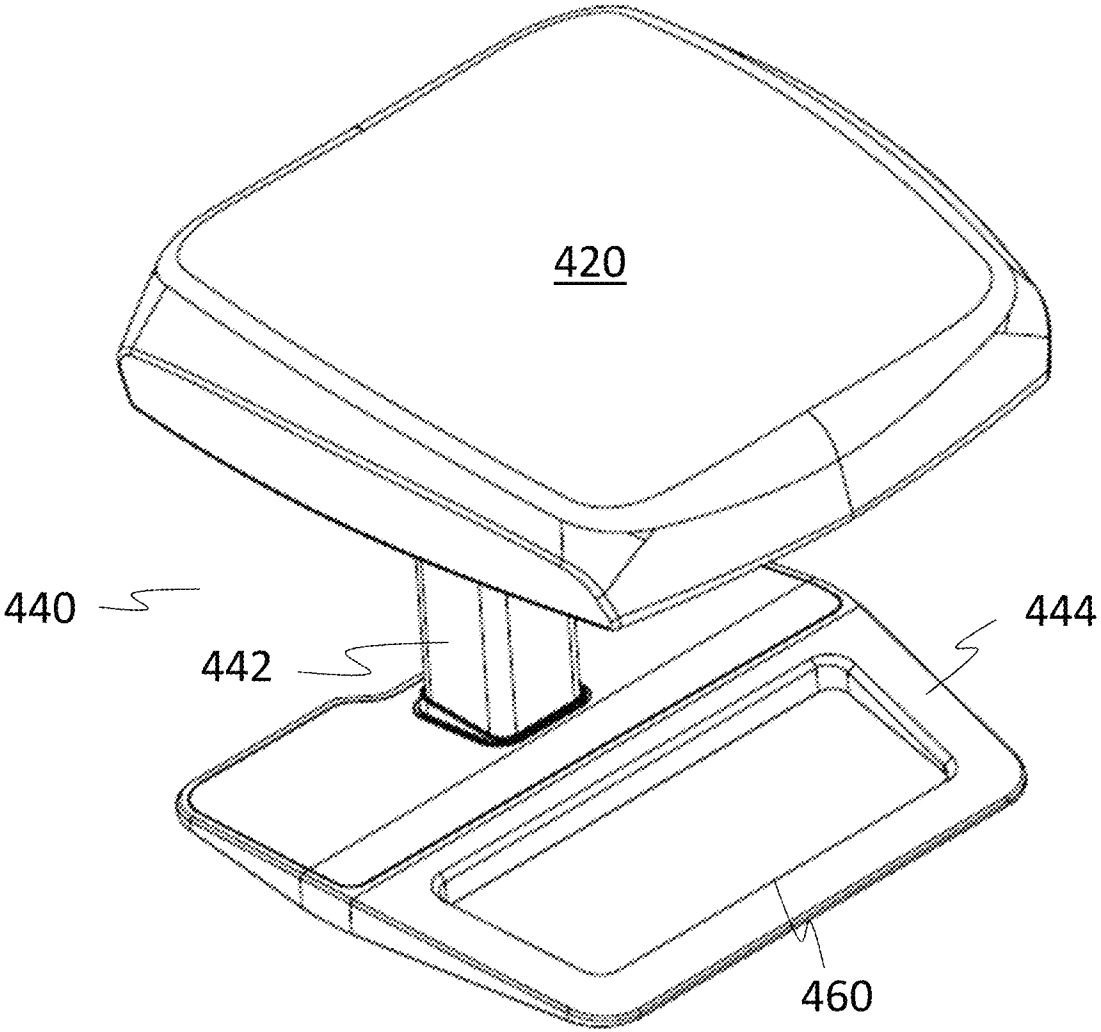
FIG. 17B is another top perspective view of the leg rest of FIG. 17A.

With reference to the embodiment as shown in FIGS. 17A and 17B, the base 444 may comprise a slot 460. The slot 460 allows the user to grip onto the leg rest 400 so as to move the leg rest 400 to a desired location or position with ease.

Figure 18:
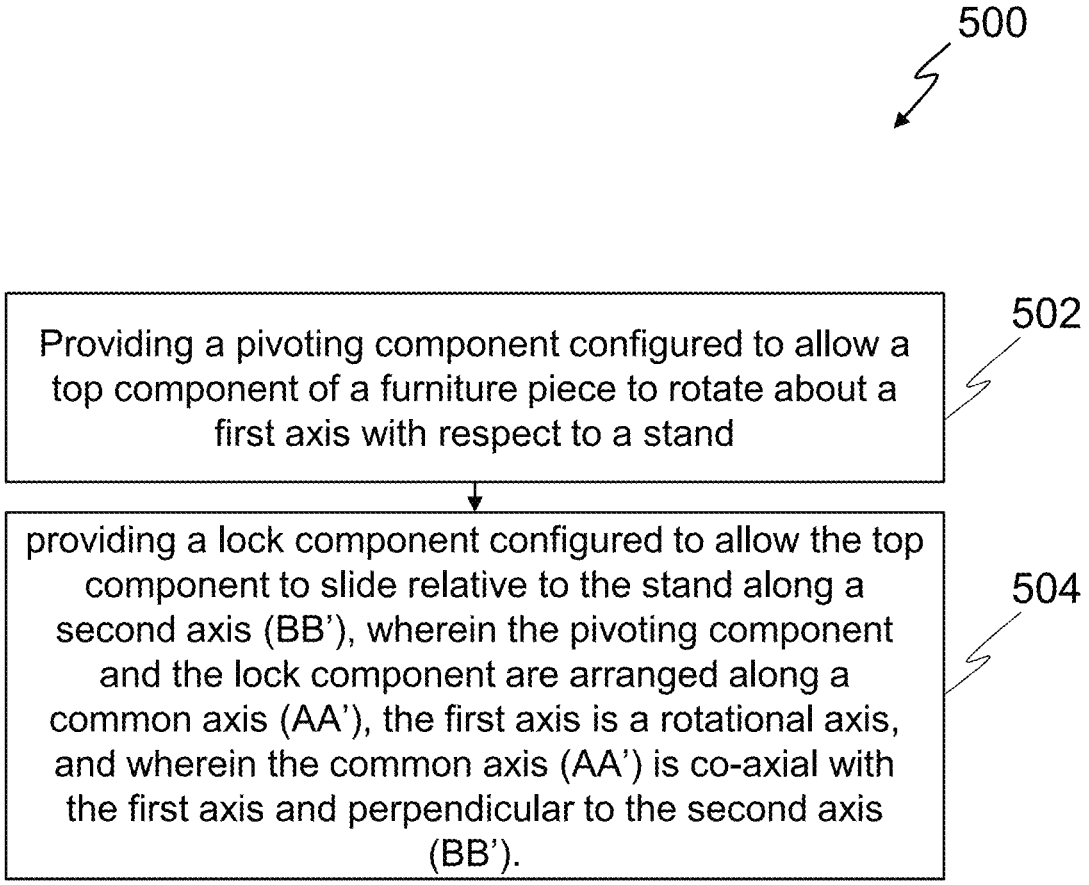
FIG. 18 is a flowchart illustrating a method of manufacturing a dual-axis adjustment device, in accordance with a third aspect of the disclosure.

FIG. 18 shows a flowchart illustrating a method 500 of manufacturing a dual-axis adjustment device. At step 502, the method 500 provides a pivoting component configured to allow a top component of a furniture piece to rotate about a first axis with respect to a stand. At step 504, the method 500 provides a lock component configured to allow the top component to slide relative to the stand along a second axis (BB'), the pivoting component and the lock component are arranged along a common axis (AA'), the first axis is a rotational axis, and the common axis (AA') is co-axial with the first axis and perpendicular to the second axis (BB'). The method 500 of manufacturing the dual-axis adjustment device may refer to the dual-axis adjustment device 100 described with reference to FIGS. 1 to 10 and repeated descriptions will be omitted.

It is contemplated that the described adjustment device 100 may be attached to various types of furniture, including but not limiting to stools and sofas.

While the disclosure has been particularly shown and described with reference to specific embodiments, it should be understood by those skilled in the art that various changes in form and detail may be made therein without departing from the scope of the disclosure as defined by the appended claims. The scope of the disclosure is thus indicated by the appended claims and all changes which come within the meaning and range of equivalency of the claims are therefore intended to be embraced.

The invention claimed is:

1. A dual-axis adjustment device, comprising:

a pivoting component configured to allow a top component of a furniture piece to rotate about a first axis with respect to a stand; and a lock component configured to allow the top component to slide relative to the stand along a second axis (BB');

wherein the pivoting component and the lock component are arranged along a common axis (AA'), the first axis is a rotational axis, and wherein the common axis (AA') is co-axial with the first axis and perpendicular to the second axis (BB'), wherein the pivoting component comprises a cylindrical mount, a gear lock, and a rotatable arm, the cylindrical mount shaped and dimensioned to receive the gear lock and the rotatable arm, and wherein the cylindrical mount and the gear lock comprises a first set of gear teeth and a second set of gear teeth respectively, the first set of gear teeth operatively engageable with the second set of gear teeth, and wherein the rotatable arm is arranged to support the top component of the furniture piece, the rotatable arm configured to engage with the gear lock, wherein in a locked position, the second set of gear teeth engages the first set of gear teeth and in an unlocked position, the second set of gear teeth disengages from the first set of gear teeth.

2. The adjustment device of claim 1, further comprising a first trigger mechanism pivoted on the cylindrical mount, wherein the gear lock comprises a slot configured to function as a cam slot, and wherein the first trigger mechanism comprises a shaft configured to function as a cam follower to engage the slot of the gear lock in a manner such as to engage or disengage the second set of gear teeth from the first set of gear teeth.

3. The adjustment device of claim 2, further comprising a biasing mechanism having a first end and a second end, wherein the first end is mounted on the rotatable arm and the second end is attached to the first trigger mechanism.

4. The adjustment device of claim 1, further comprising a coil spring, the coil spring configured to provide a preloaded counter rotational motion of the rotatable arm with respect to the cylindrical mount when the gear lock is disengaged.

5. The adjustment device of claim 2, further comprising a first trigger pedal, the first trigger pedal comprising a handle and an engagement portion to engage the first trigger mechanism in a manner such as to rotate the first trigger mechanism.

6. The adjustment device of claim 5, wherein the lock component comprises, a linkage arm, a connector and a rod, wherein the rod is pivotably connected to the connector, and wherein the linkage arm is configured to provide an upward force on the rod.

7. The adjustment device of claim 6, further comprising a mounting arm, wherein the mounting arm is arranged to support the top component of the furniture piece.

8. The adjustment device of claim 7, further comprising a second trigger mechanism, wherein the mounting arm comprises a slot configured to function as a cam slot, and wherein the second trigger mechanism comprises a shaft configured to function as a cam follower to engage the slot of the mounting arm in a manner such as to rotate the linkage arm about a pivot on the mounting arm.

9. The adjustment device of claim 8, further comprising a second trigger pedal, the second trigger pedal comprising a handle and an engagement portion to engage the second trigger mechanism in a manner such as to rotate the second trigger mechanism.

10. The adjustment device of claim 9, wherein the second trigger pedal remains at a constant angle with respect to the top component when the top component is rotated about the first axis with respect to the stand.

11. A leg rest comprising a top component and a stand, the top component rotatably mounted to the stand about a first axis and slidable from the stand along a second axis (BB'), the leg rest comprises an adjustment device, the adjustment device comprises:

a pivoting component configured to allow the top component to rotate about the first axis; and a lock component configured to allow the top component to slide relative to the stand along the second axis (BB'), wherein the pivoting component and the lock component are arranged along a common axis (AA'), the first axis is a rotational axis, and the common axis (AA') is co-axial with the first axis and perpendicular to the second axis (BB'), wherein the pivoting component comprises a cylindrical mount, a gear lock, and a rotatable arm, the cylindrical mount shaped and dimensioned to receive the gear lock and the rotatable arm, and wherein the cylindrical mount and the gear lock comprises a first set of gear teeth and a second set of gear teeth respectively, the first set of gear teeth operatively engageable with the second set of gear teeth, and wherein the rotatable arm is arranged to support the top component of the furniture piece, the rotatable arm configured to engage with the gear lock, wherein in a locked position, the second set of gear teeth engages the first set of gear teeth and in an unlocked position, the second set of gear teeth disengages from the first set of gear teeth.

12. The leg rest of claim 11, wherein the stand comprises a support and a base, and wherein the top component is attachable to the support.

13. The leg rest of claim 12, wherein the support comprises an elongated housing to contain the pivoting component and the lock component therein, wherein the elongated housing has a longitudinal axis which is the common axis (AA').

14. A method of manufacturing a dual-axis adjustment device, the method comprising:

a step of providing a pivoting component configured to allow a top component of a furniture piece to rotate about a first axis with respect to a stand; and a step of providing a lock component configured to allow the top component to slide relative to the stand along a second axis (BB'), wherein the pivoting component and the lock component are arranged along a common axis (AA'), the first axis is a rotational axis, and wherein the common axis (AA') is co-axial with the first axis and perpendicular to the second axis (BB'), wherein the pivoting component comprises a cylindrical mount, a gear lock, and a rotatable arm, the cylindrical mount shaped and dimensioned to receive the gear lock and the rotatable arm, and wherein the cylindrical mount and the gear lock comprises a first set of gear teeth and a second set of gear teeth respectively, the first set of gear teeth operatively engageable with the second set of gear teeth, and wherein the rotatable arm is arranged to support the top component of the furniture piece, the rotatable arm configured to engage with the gear lock, wherein in a locked position, the second set of gear teeth engages the first set of gear teeth and in an unlocked position, the second set of gear teeth disengages from the first set of gear teeth.

15. The adjustment device of claim 1, wherein the lock component comprises, a linkage arm, a connector and a rod, wherein the rod is pivotably connected to the connector, and wherein the linkage arm is configured to provide an upward force on the rod.

16. The adjustment device of claim 15, further comprising a mounting arm, wherein the mounting arm is arranged to support the top component of the furniture piece.

* * * * *